United States Patent [19]

Hyde

[11] 4,417,622

[45] Nov. 29, 1983

[54] WELL SAMPLING METHOD AND APPARATUS

[75] Inventor: Walter E. Hyde, Duncan, Okla.

[73] Assignee: Halliburton Company, Duncan, Okla.

[21] Appl. No.: 272,051

[22] Filed: Jun. 9, 1981

[51] Int. Cl.[3] ..... E21B 34/14; E21B 49/08

[52] U.S. Cl. ..... 166/264; 73/863.71; 73/864; 166/64; 166/169; 166/332

[58] Field of Search ..... 166/264, 334, 332, 162–169, 166/317, 319; 73/151, 863.71, 864

[56] References Cited

U.S. PATENT DOCUMENTS

| | | | |
|---|---|---|---|
| Re. 29,562 | 3/1978 | Wray et al. | 166/162 X |
| 1,753,066 | 4/1930 | Poole et al. | 166/164 |
| 2,364,464 | 12/1944 | Moore | 166/164 X |
| 2,595,084 | 4/1952 | Kriegel | 166/165 |
| 2,740,479 | 3/1956 | Schwegman | 166/145 |
| 3,358,755 | 12/1967 | Chisholm | 166/264 |
| 3,493,052 | 2/1970 | Evans et al. | 166/332 X |
| 3,646,995 | 3/1972 | Manes et al. | 166/152 X |
| 3,664,415 | 5/1972 | Wray et al. | 166/162 X |
| 3,850,250 | 11/1974 | Holden et al. | 166/126 X |
| 3,858,649 | 1/1975 | Wray et al. | 166/162 |
| 3,860,069 | 1/1975 | Wray et al. | 166/264 |
| 3,930,540 | 1/1976 | Holden et al. | 166/95 X |
| 3,964,305 | 6/1976 | Wray et al. | 73/151 |
| 4,047,564 | 9/1977 | Nix et al. | 166/334 X |
| 4,058,165 | 11/1977 | Holden et al. | 166/373 |
| 4,059,153 | 11/1977 | Nix et al. | 166/264 |
| 4,063,593 | 12/1977 | Jessup | 166/317 |
| 4,076,077 | 2/1978 | Nix et al. | 166/334 X |
| 4,113,012 | 9/1978 | Evans et al. | 166/264 |

*Primary Examiner*—Stephen J. Novosad

*Attorney, Agent, or Firm*—L. Wayne Beavers; James R. Duzan; Thomas R. Weaver

[57] ABSTRACT

Apparatus and methods are provided for taking a sample of a fluid in a well. The apparatus comprising a housing, a telescoping sampler assembly having a sleeve valve therein, an actuating mandrel and a time delay fluid control device which controls the opening of the sleeve valve. The method of operation of the sampler comprising evacuating the sample chamber of the sampler assembly, lowering the sampler assembly into a well, and collecting a fluid sample by flowing fluid into the sampler assembly from the well by opening and closing a sleeve valve in the sampler assembly utilizing a continuous sliding movement.

28 Claims, 34 Drawing Figures

WELL SAMPLING METHOD AND APPARATUS

The present invention relates generally to apparatus and methods for sampling a fluid produced from a subterranean formation into an oil or gas well.

It is often desired to withdraw a sample, of the fluid produced from a subterranean formation into an oil or gas well, by lowering a sampler apparatus into the well and taking a sample of the produced fluid.

Sometimes the fluid produced from the subterranean formation includes dangerous gases such as the highly toxic hydrogen sulfide gas. The testing of sour gas formations with the prior art apparatus and methods presents a hazard of producing the highly toxic hydrogen sulfide to the surface. Also when pulling the pipe string at the conclusion of the test, the pipe string must be unloaded by reverse circulation of the residual formation fluids. Where high pressure formations are involved, the hydrogen sulfide gas volume to be disposed of may be enormous.

The present invention provids a safe manner by which to sample a formation which contains hydrogen sulfide or other toxic substances. The hazard of producing these formation fluids to the surface is eliminated. At the conclusion of the sampling, the residual formation fluids are pumped back into the formation and the mud column is restored against the face of the formation.

The apparatus of the present invention includes a housing with a sampler assembly received within the housing. The sampler assembly includes first and second tubular sections which are telescopingly assembled so that a sampler chamber is defined by the interiors of the first and second tubular sections.

An arrangement of ports and seals is associated with the telescoping tubular sections and provides a sleeve valve means which is movable from a closed first position through an open second position to a closed third position upon one continuous telescopingly collapsing movement between the first and second tubular sections. When the sleeve valve means is in the open position the sample chamber is communicated with an annular space between the housing and the tubular sections.

Located above the sampler assembly within the housing is an actuating mandrel means for engaging an upper end of one of the tubular sections of the sampler assembly and for telescopingly collapsing the first and second tubular sections so as to produce the telescoping movement therebetween.

A time-delay means is operatively associated with the actuating mandrel for retarding downward movement of the actuating mandrel so that the valve means is open for a predetermined period of time before it moves to its said closed third position.

The methods of the present invention may be performed with the apparatus of the present invention.

The sample chamber of the sampler assembly is evacuated and then placed in the housing. The housing is attached to the lower end of the pipe string, and a packer means is attached to a lower end of the housing. The pipe string is then lowered into the well.

Formation fluid from the subterranean formation is allowed to flow upward around the sampler assembly and past the sampler assembly while the sample chamber remains evacuated. The sleeve valve means is then opened thereby communicating the sample chamber with the fluid being produced from the subterranean formation for a period of time sufficient to allow the sample chamber to fill with a sample of the produced fluid. Then the valve means is closed sealing the sample of produced fluid in the sample chamber.

During this procedure the fluid being produced from the subterranean formation does not flow through the sample chamber. The sample chamber merely withdraws a small sample from the fluid, which sample is then sealed within the sample chamber.

Numerous objects, features, and advantages of the present invention will be readily apparent to those skilled in the art upon a reading of the following disclosure when taken in conjunction with the accompanying drawings.

FIG. 6 shows the pipe string with the sampling apparatus being pulled out of the well.

FIGS. 7A–7K comprise a sectional elevation right side only view of one embodiment of the sampling apparatus of the present invention.

Figure 7A:
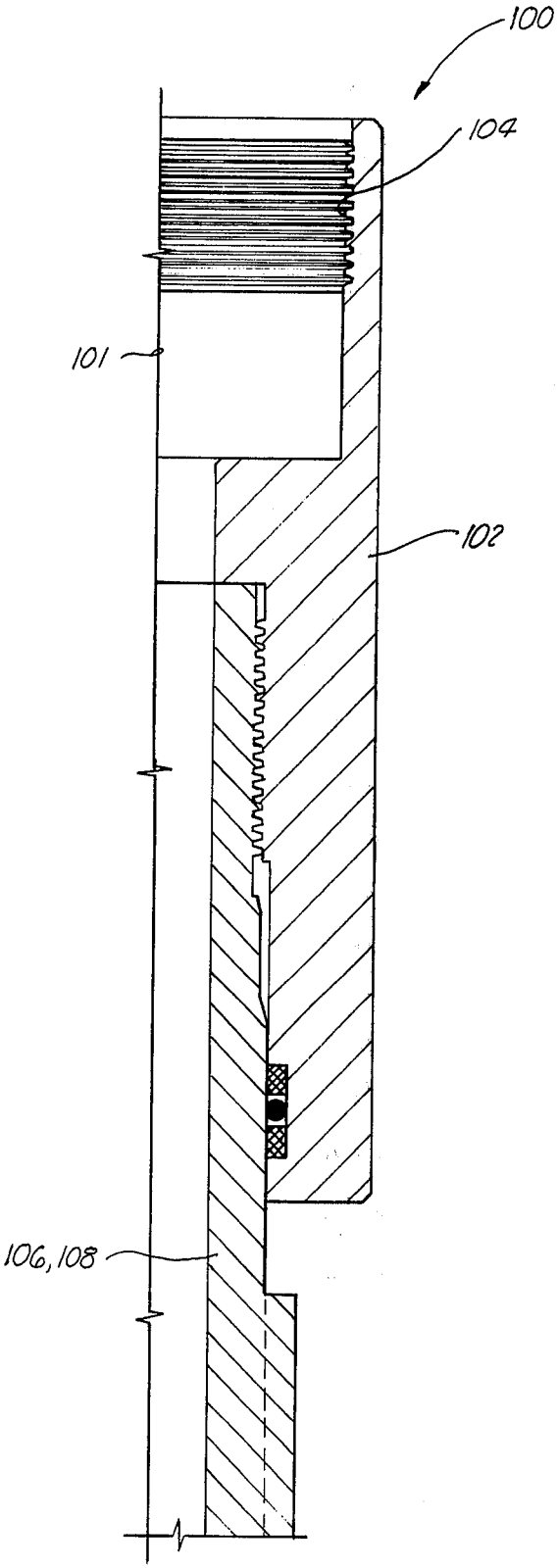
Figure 7B:
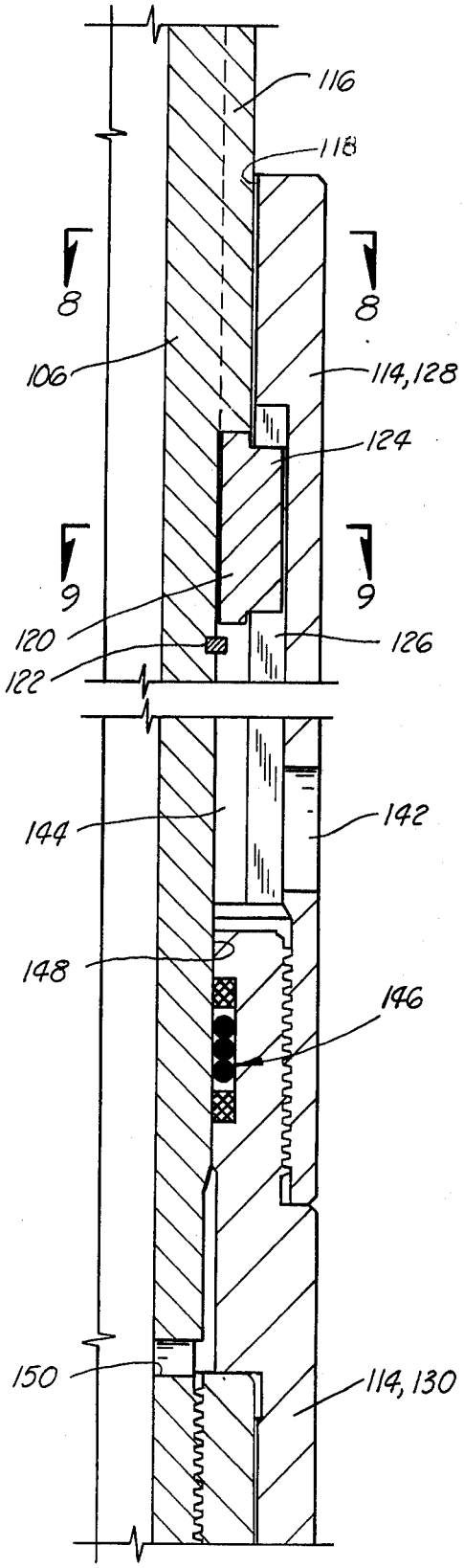
Figure 8:
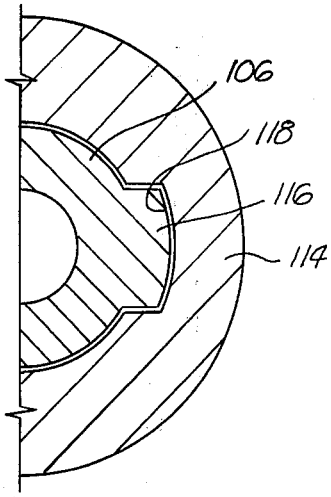

FIG. 8 is a section view along line 8—8 of FIG. 7B.

Figure 9:
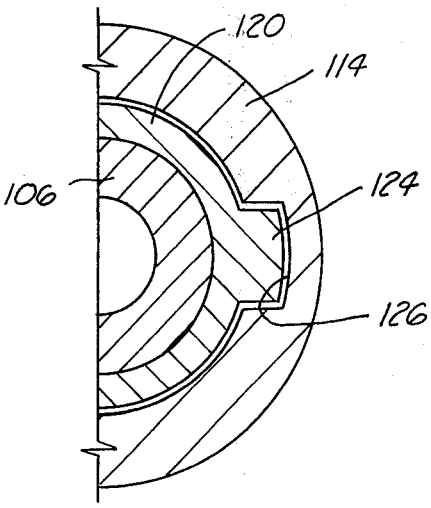

FIG. 9 is a section view along line 9—9 of FIG. 7B.

Figure 7C:
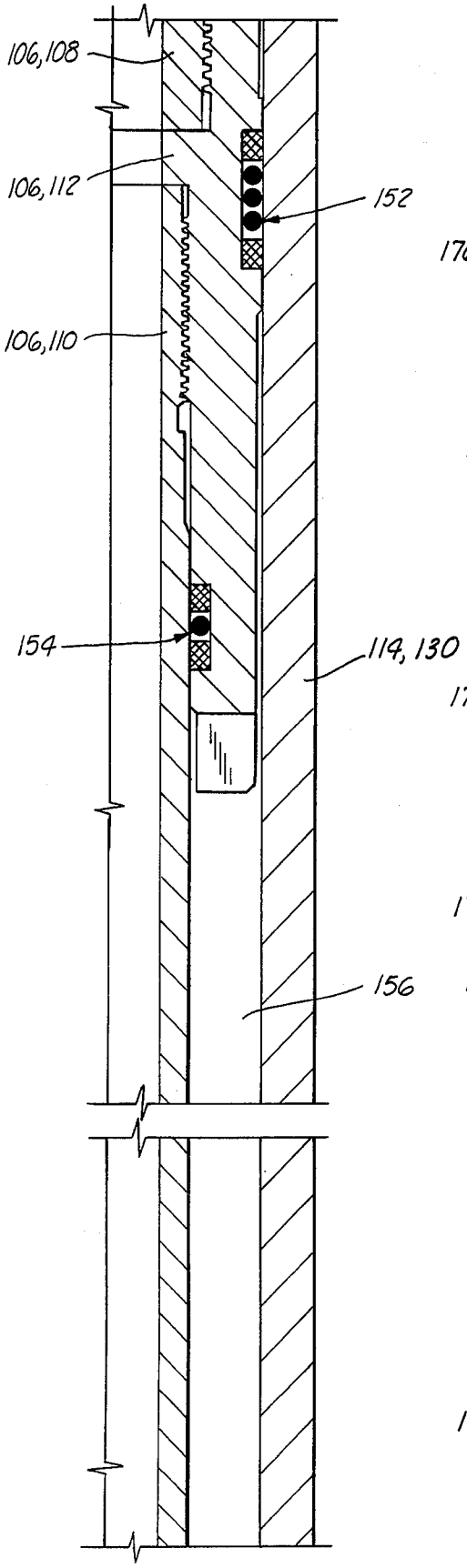
Figure 7D:
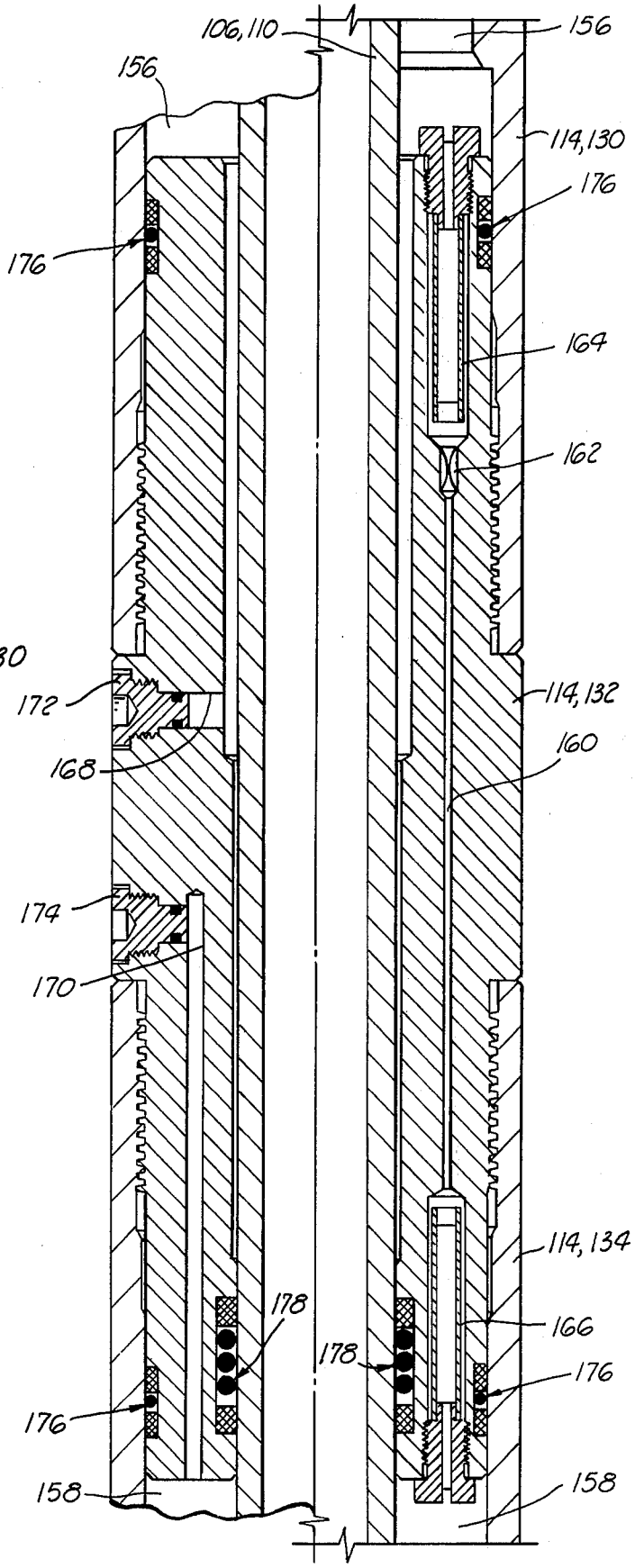
Figure 7E:
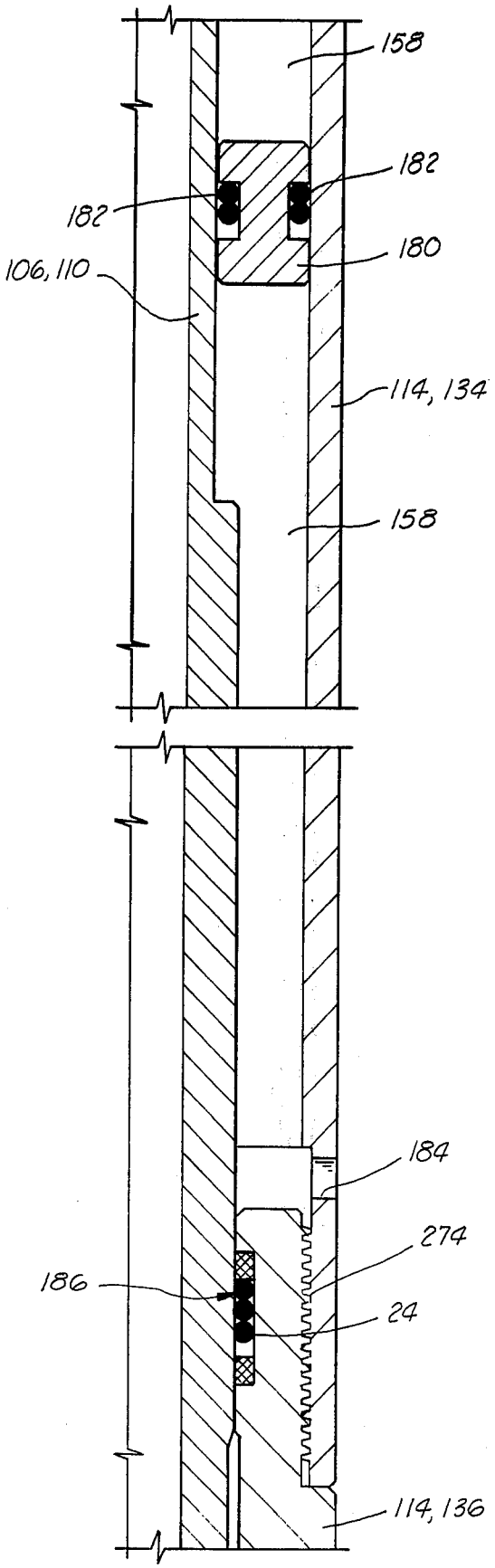
Figure 7F:
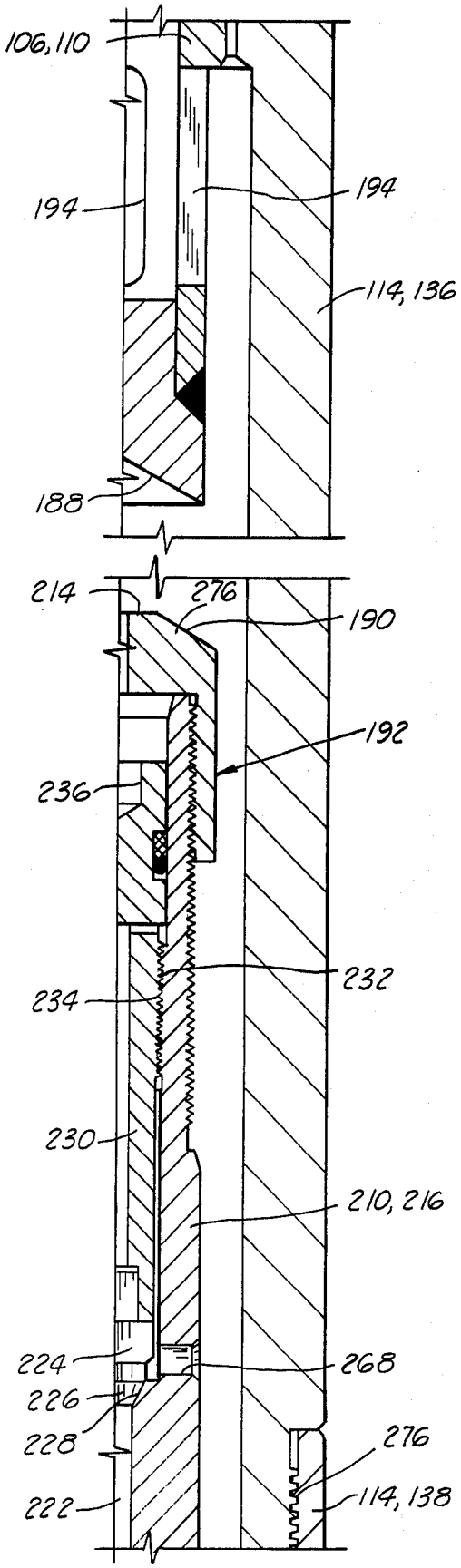
Figure 7G:
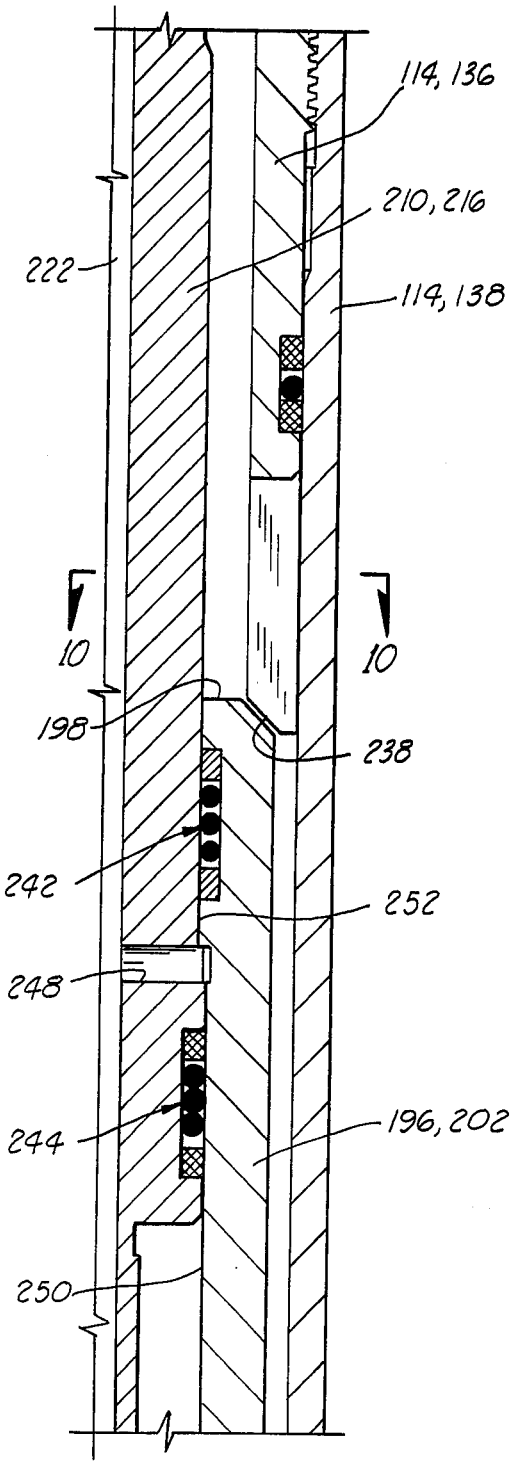
Figure 7H:
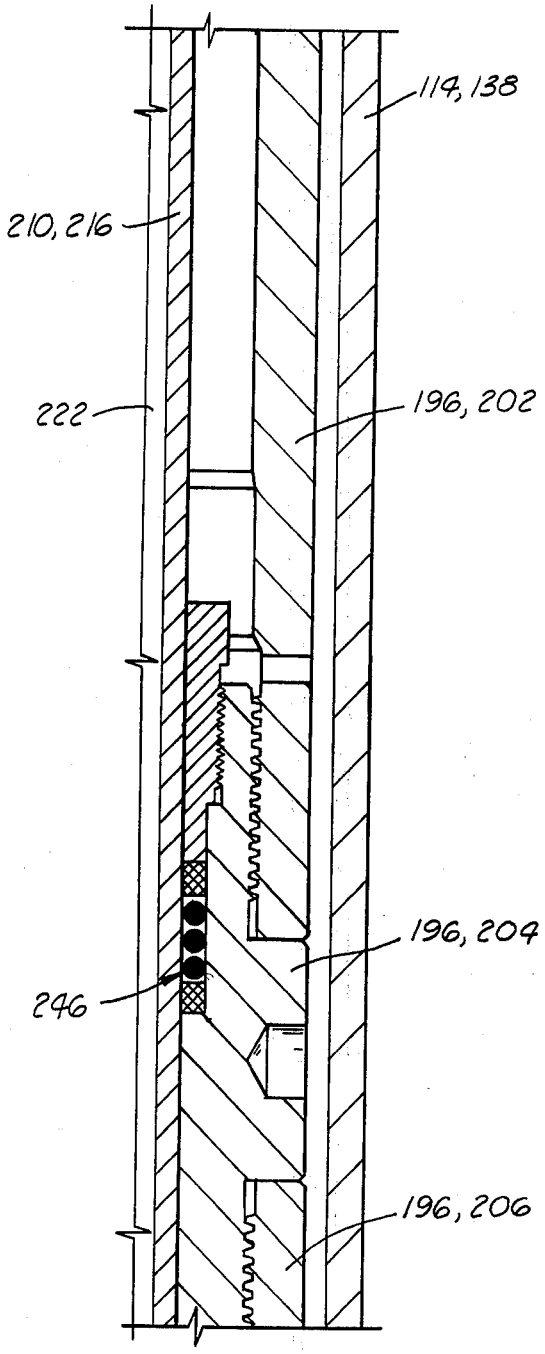
Figure 10:
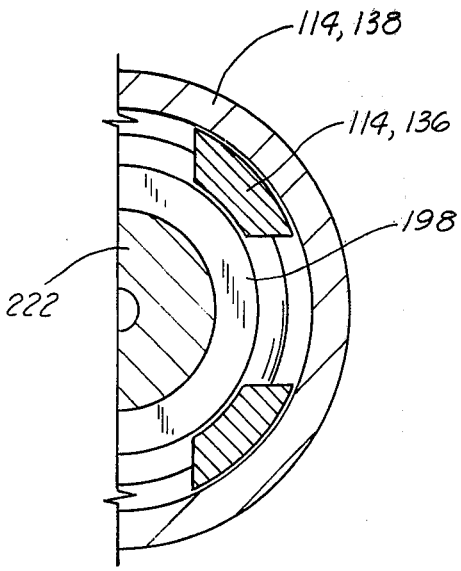

FIG. 10 is a section view along line 10—10 of FIG. 7G.

Figure 7I:
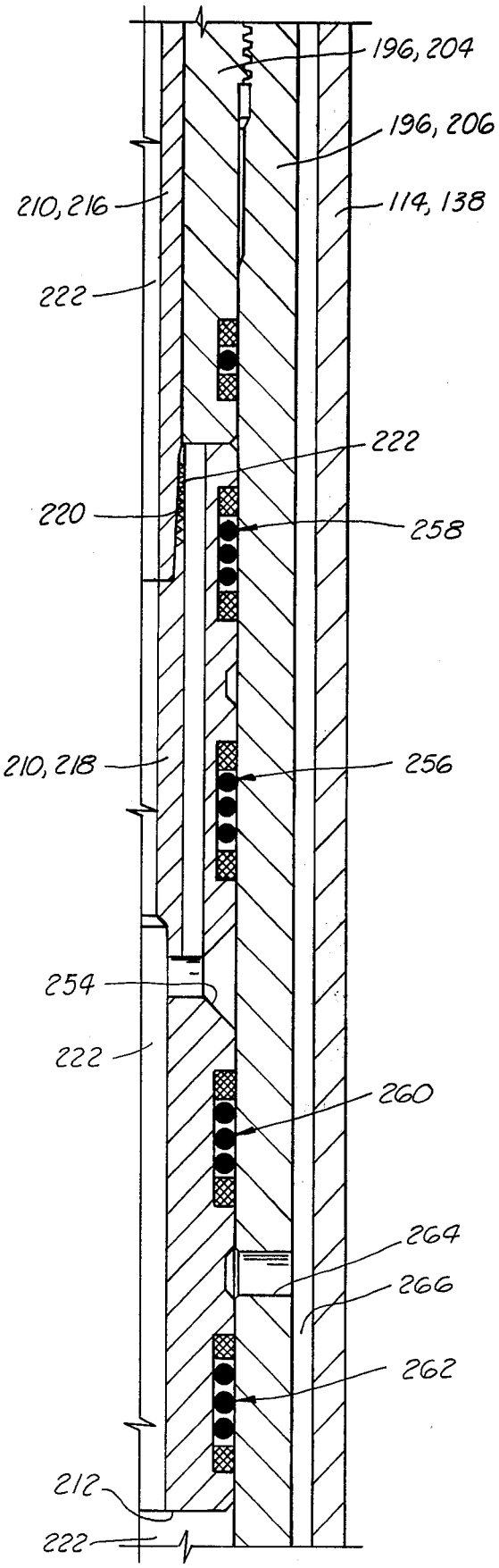
Figure 7J:
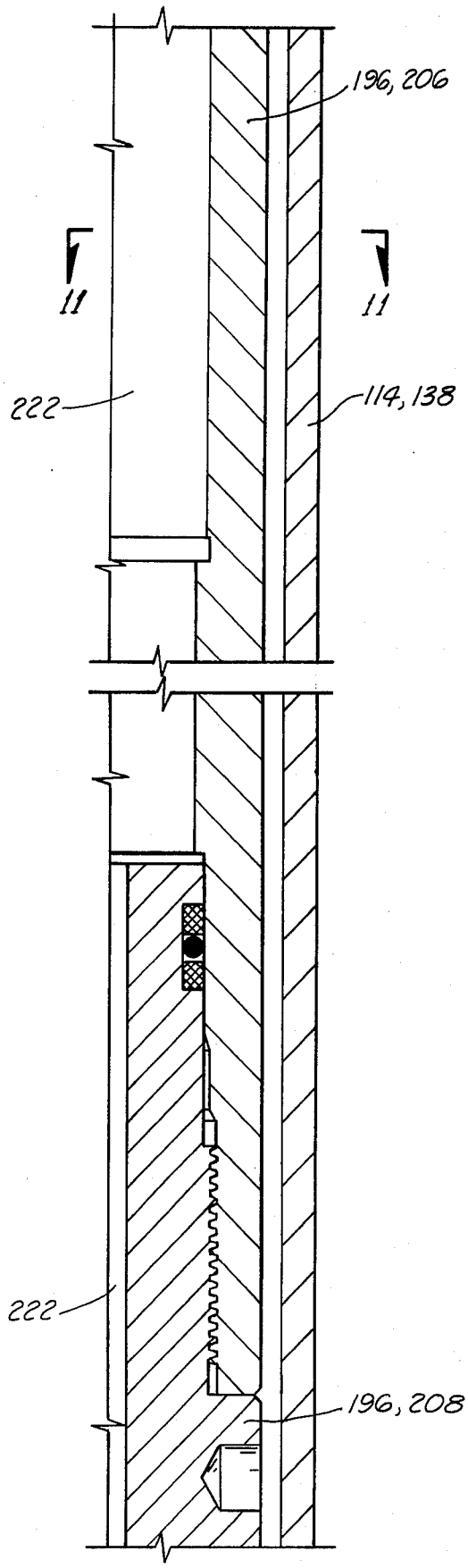
Figure 11:
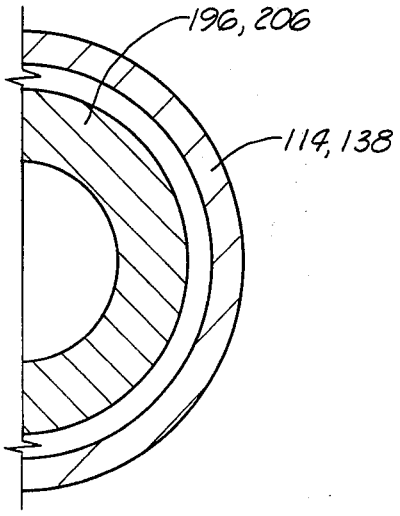

FIG. 11 is a section view along line 11—11 of FIG. 7J.

Figure 12:
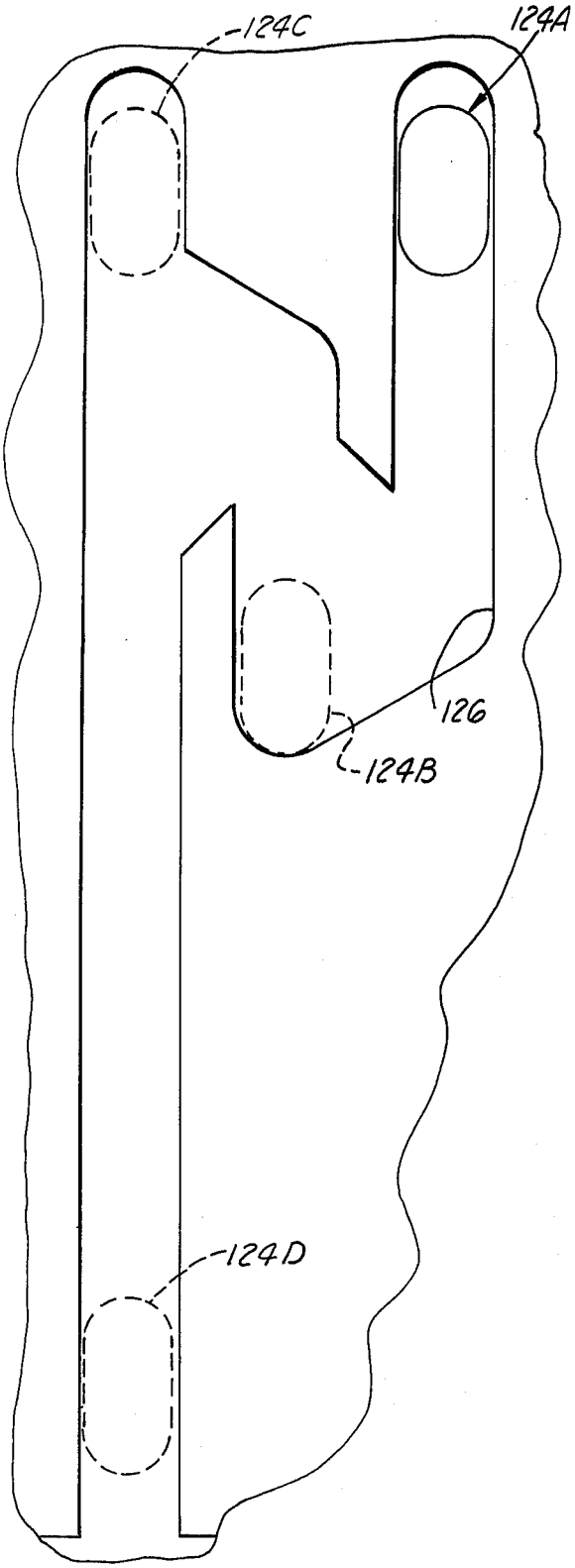

FIG. 12 is a laid-out view of the J-slot arrangement of FIG. 7B.

Figure 13:
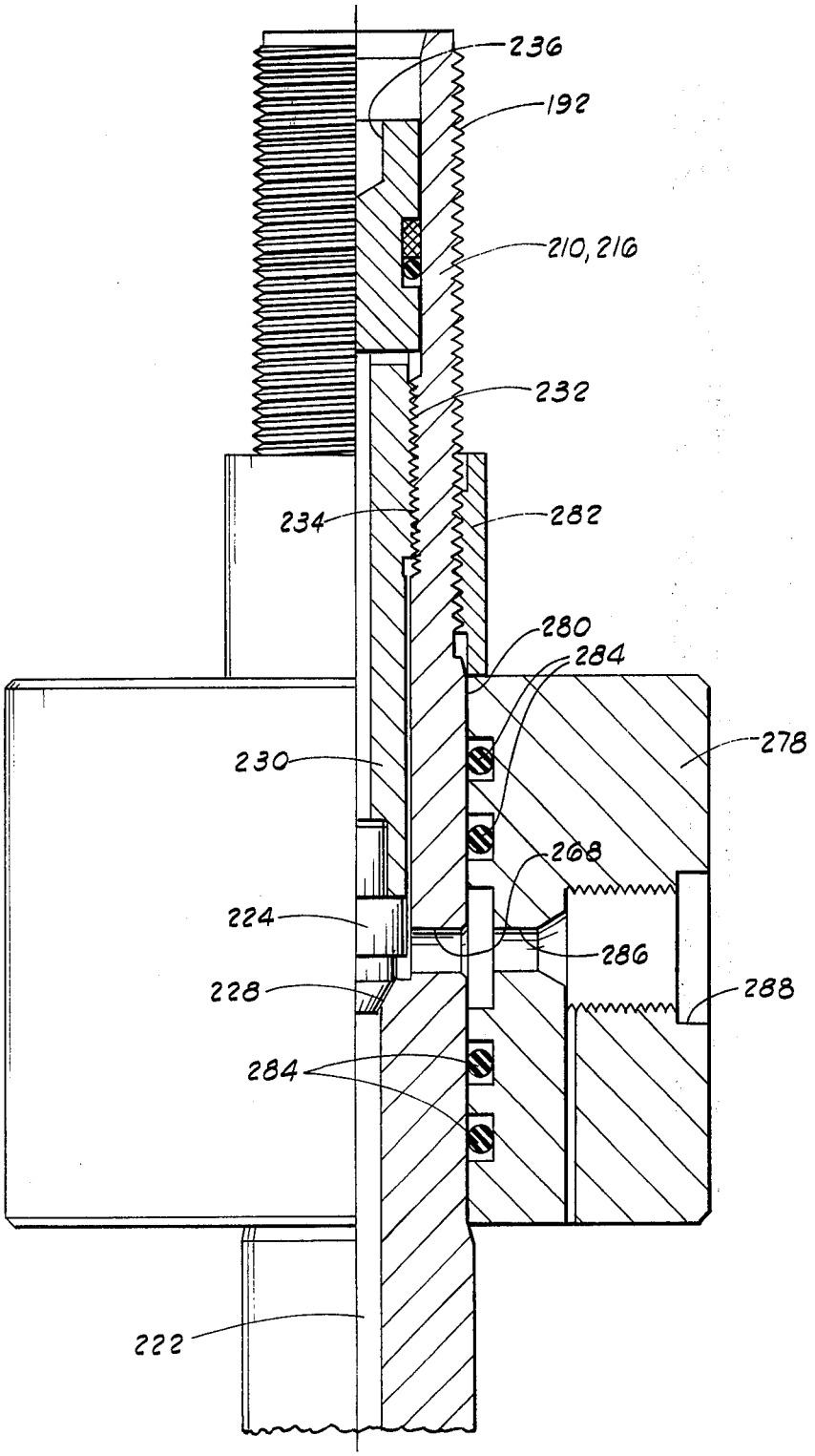
Figure 14A:
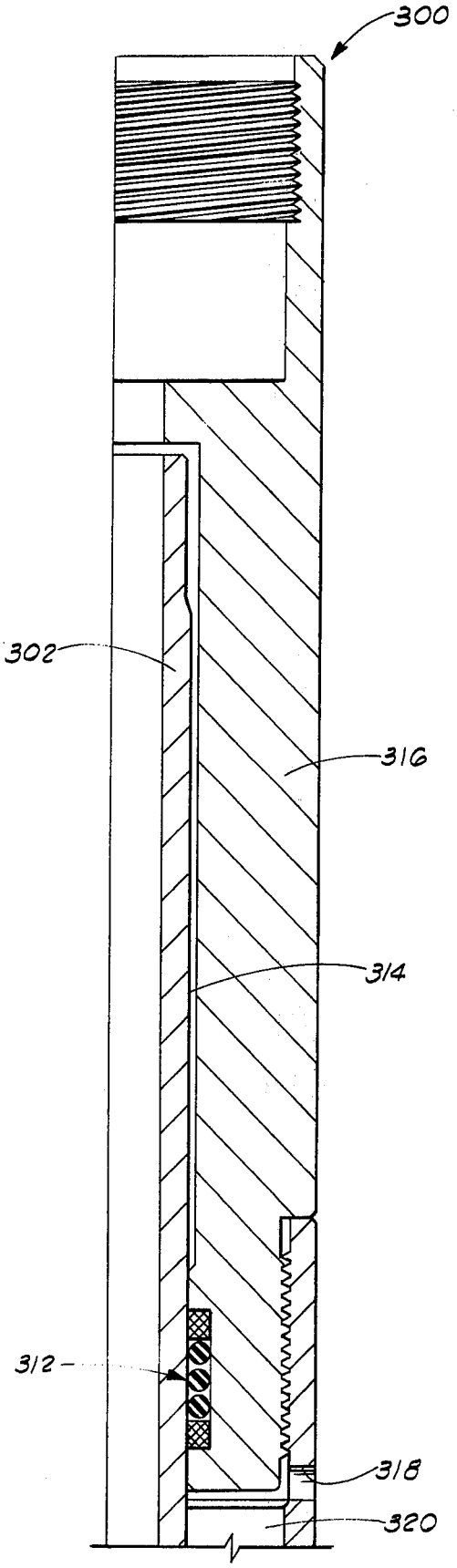
Figure 14B:
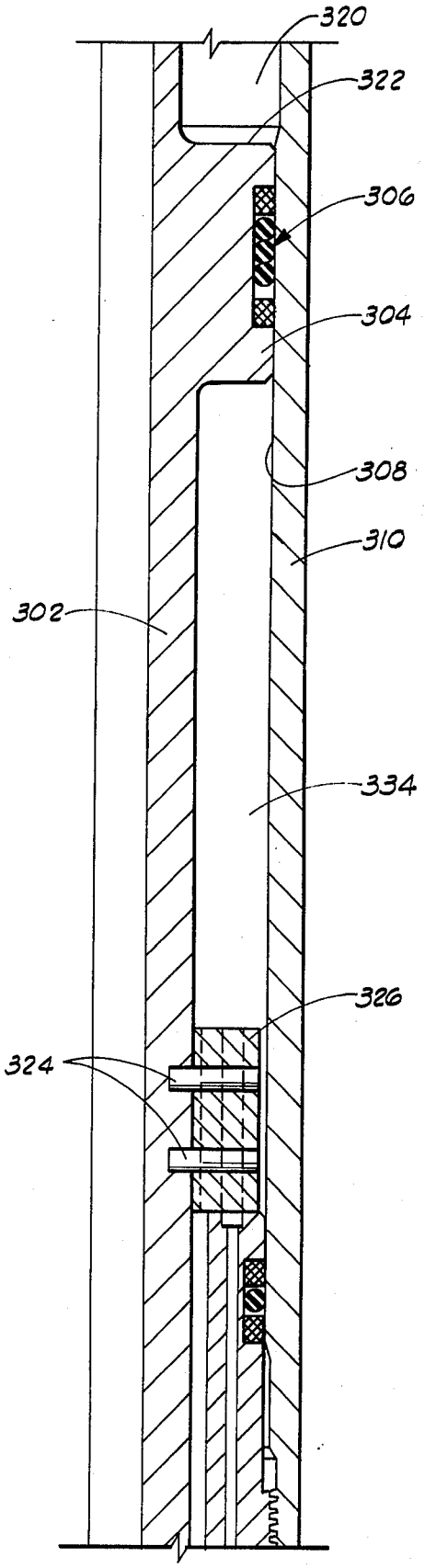
Figure 14C:
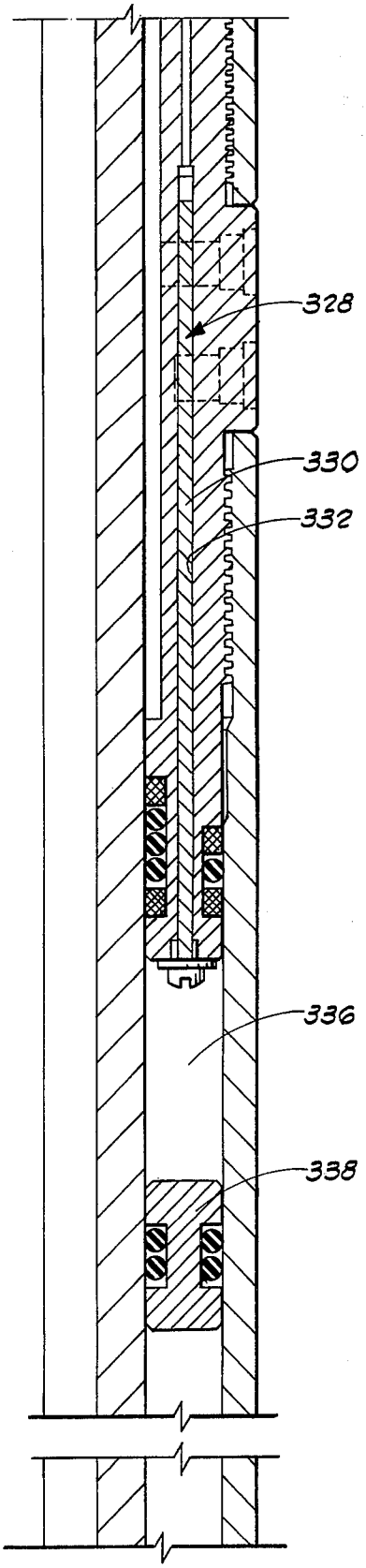
Figure 14D:
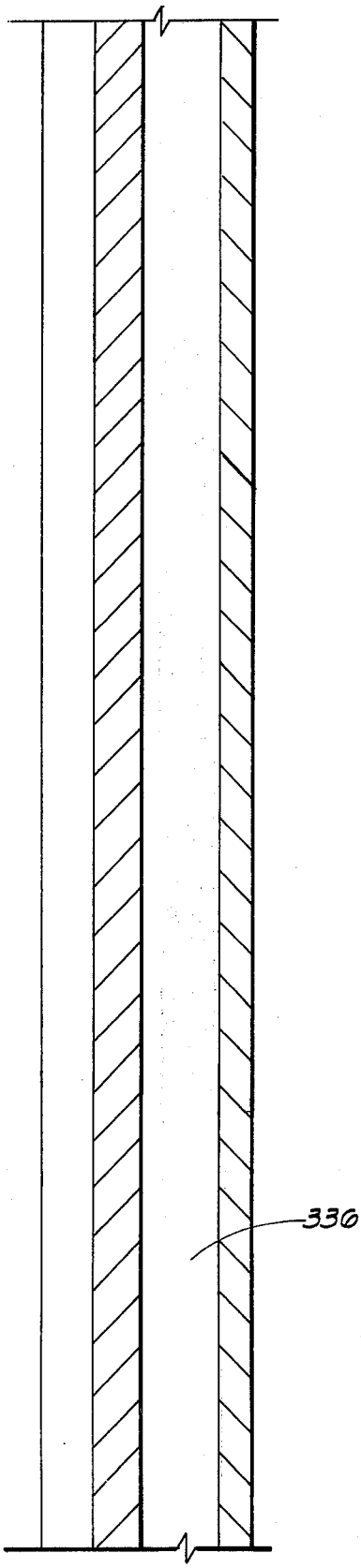
Figure 14E:
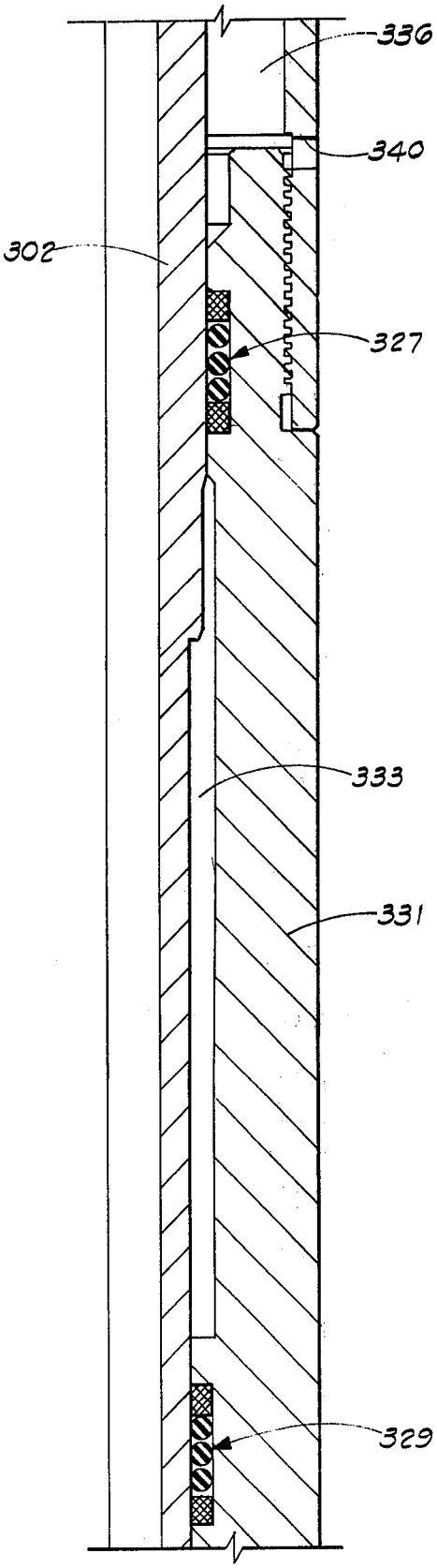
Figure 14F:
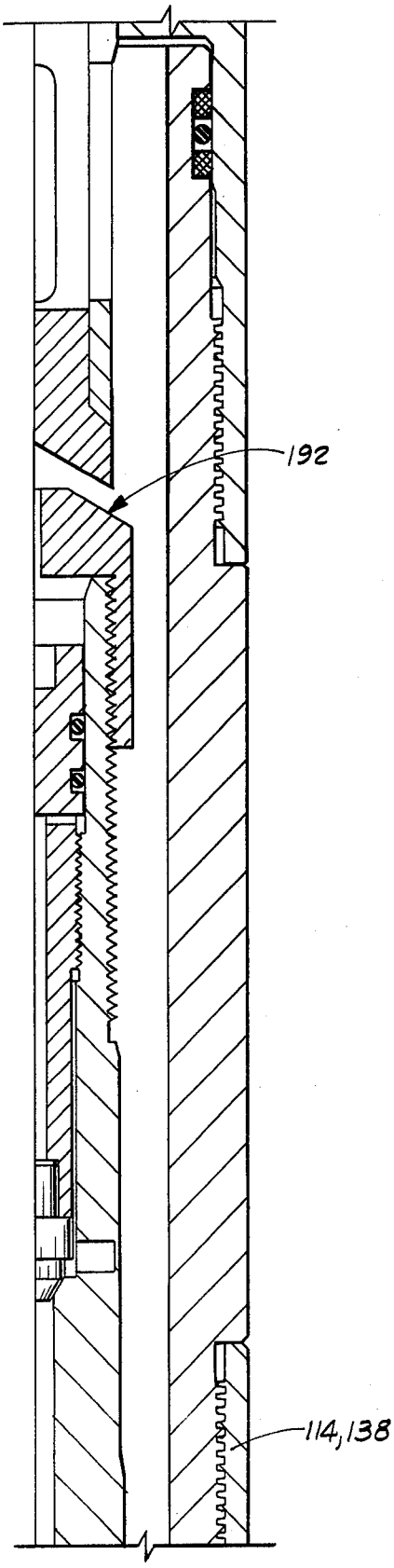

FIG. 13 is a partly sectioned elevation view of the upper end of the sampler assembly of FIG. 7F which has been removed from the outer housing and which has been assembled with an apparatus for removing the sample from the sampler assembly.

FIGS. 14A–14F comprise a sectioned elevation right side only view of an alternative embodiment of an actuating means which may be substituted for the apparatus shown in FIGS. 7A–7F.

FIGS. 15A–15E show another alternative embodiment of an actuating means which may be substituted for the apparatus shown in FIGS. 7A–7F.

Referring now to the drawings and particularly to FIGS. 1–6, a well 10 is defined by well bore 12 and extends from a surface 14 to a depth intersecting a subterranean formation the upper extent of which is indicated by the numeral 16.

The well bore 12 is generally defined by an inner cylindrical surface of a well casing (not shown). The well bore 12 is communicated with the subterranean formation 16 by perforations 18 through the casing.

Figure 1:
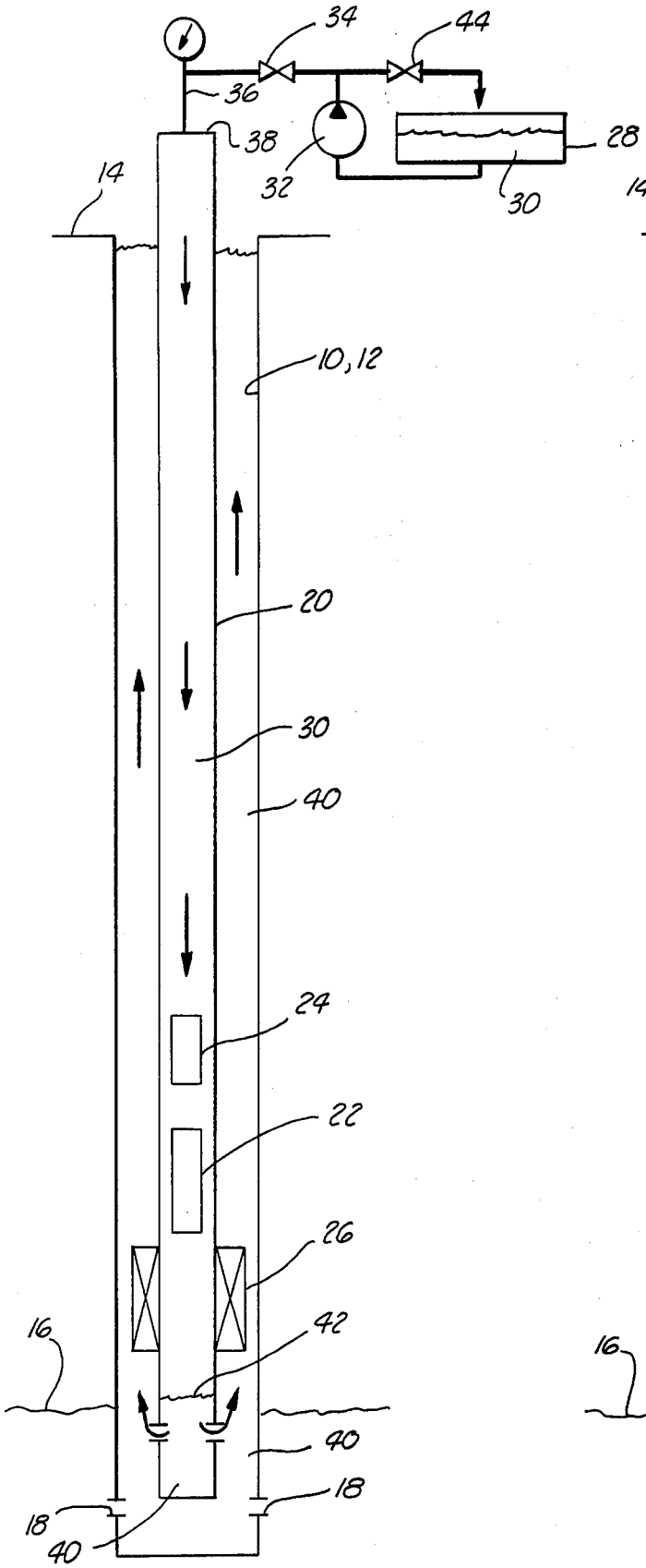
FIG. 1 is a schematic elevation view of a pipe string having the fluid sampling apparatus of the present invention attached thereto. The pipe string has been lowered into the well and a low gravity displacing fluid has been pumped down into the pipe string displacing the drilling mud from the interior of the pipe string.

A pipe string 20 is represented schematically in FIG. 1 as having a sampler assembly 22 and a pressure recorder 24 disposed therein.

Attached to the lower end of the pipe string is a packer means 26.

At the surface 14 a storage tank 28 holds a low gravity displacing fluid 30. A pump 32 pumps the low gravity displacing fluid 30 through a valve 34 and a conduit 36 into an upper end 38 of the pipe string 20.

In FIG. 1 the pipe string 20 has been lowered into the well bore 12 to a position adjacent the subterranean formation 16, and low gravity displacing fluid 30 has been pumped downward into the interior of the pipe string 20 thus displacing drilling mud 40 from the interior of the pipe string 20. An interface between the displacing fluid 30 and the drilling mud 40 is indicated at 42.

Figure 2:
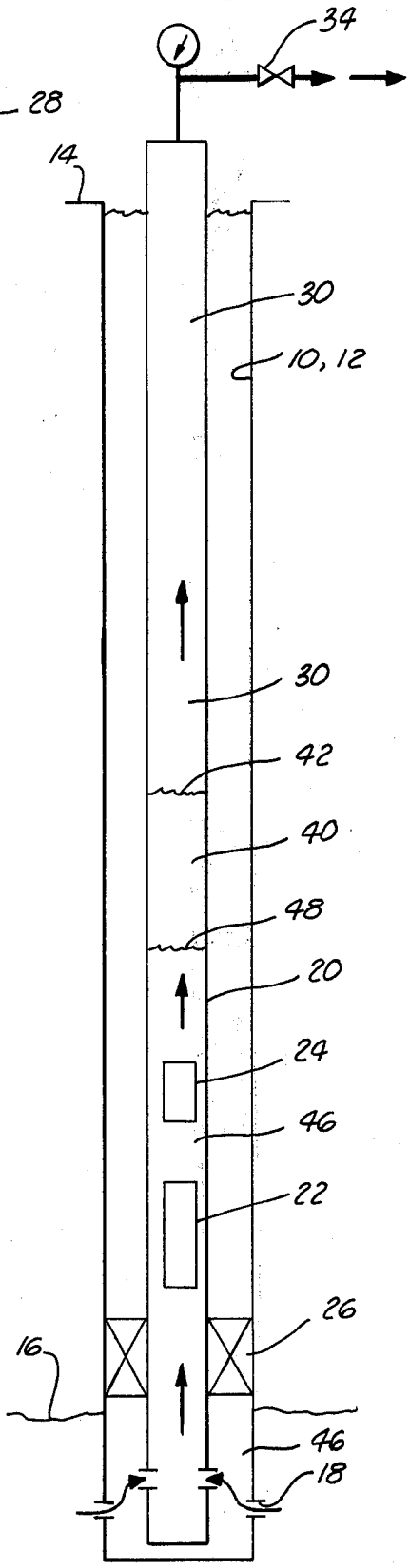
FIG. 2 is a view similar to FIG. 1 wherein the packer means has been set against the bore of the well and fluid from the subterranean formation is being produced upwards through the pipe string past the sampler apparatus.

In FIG. 2, the packer 26 has been set, and the valve 34 and a second valve 44 (see FIG.1) have been opened to allow the displacing fluid 30 to flow upwards and back into the tank 28. (see FIG. 1). Fluid 46 is produced from the formation 16 into the interior of pipe string 20 and upward around and past sampler assembly 22 and pressure recorder 24. A slug of drilling mud 40 has moved upward within the pipe string 20. The interface between the displacing fluid 30 and the drilling mud 40 is still shown as 42 which is moved upward to an intermediate point along the length of the pipe string 20. An interface between the drilling mud 40 and the produced fluid 46 is indicated at 48.

Figure 3:
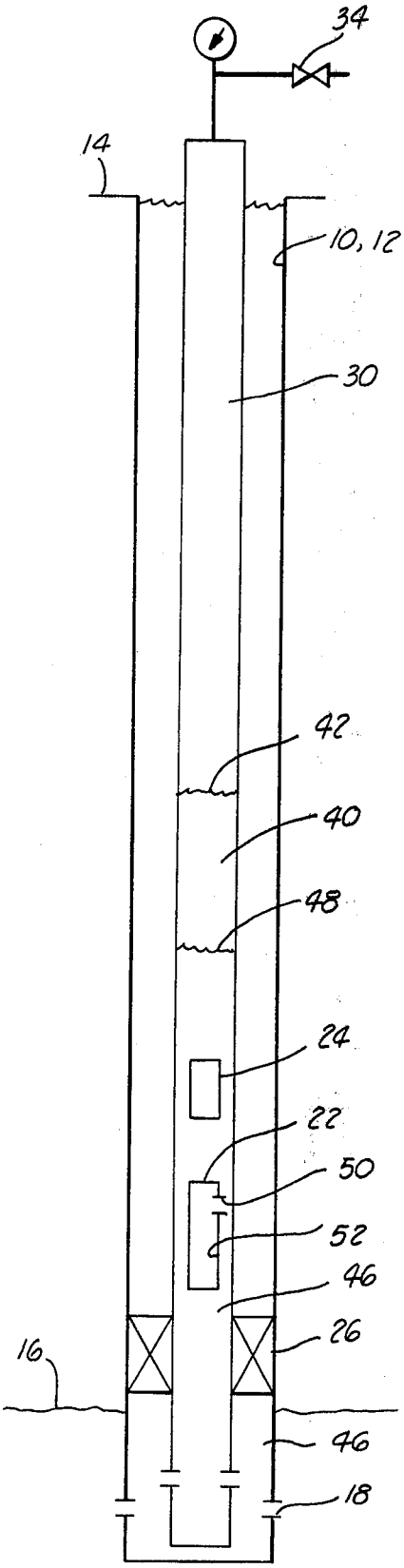
FIG. 3 is similar to FIG. 2 except the sampler assembly is shown in the open position so that a sample of the produced fluid is taken into the sampler apparatus.

Referring to FIG. 3, a valve means 50 of sampler assembly 22 has been opened so that a sample chamber 52 is filled with fluid 46 produced from the subterranean formation 16. The sample chamber 52 was initially evacuated prior to the lowering of pipe string 20 into well 10. Sample chamber 52 may be opened either while fluid 46 is flowing up pipe string 20 or when the well 10 is shut in by closing valve 34.

Figure 4:
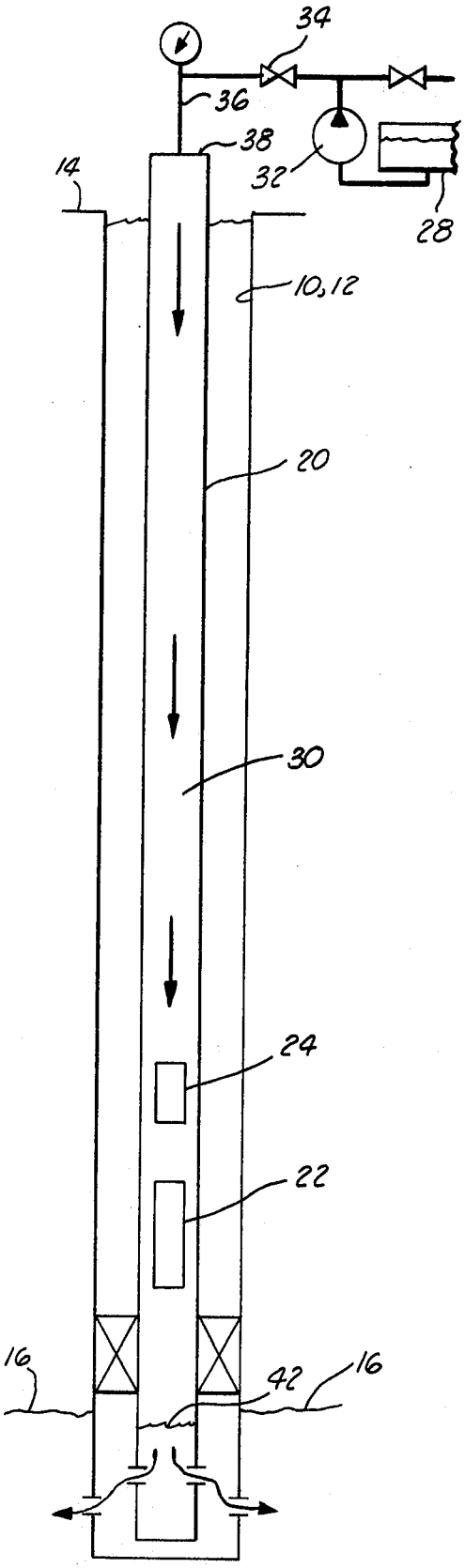
FIG. 4 shows the sampler assembly closed sealing the sample of produced fluid therein, and low gravity displacing fluid has been pumped back down into the pipe string thus forcing the produced fluid from the subterranean formation back into the subterranean formation.

In FIG. 4, the sampler apparatus 22 has been closed thus sealing a sample of the fluid produced from subterranean formation 16 therein. Once again displacing fluid from tank 28 has been pumped back down into the pipe string 20 so that all the fluid previously produced from the subterranean formation 16, except for the sample sealed in sampler apparatus 22, is forced back into the subterranean formation 16.

Figure 5:
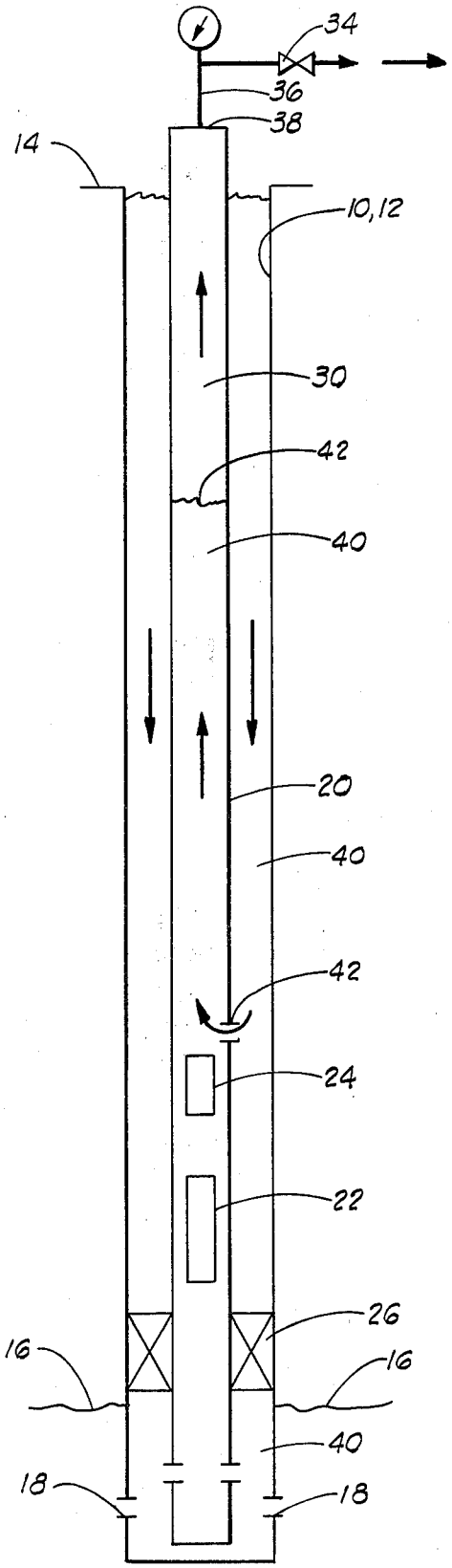
FIG. 5 shows a reversing valve in an open position so that drilling mud may enter the pipe string and force the low gravity displacing fluid up and out of the interior of the pipe string.
Figure 5:
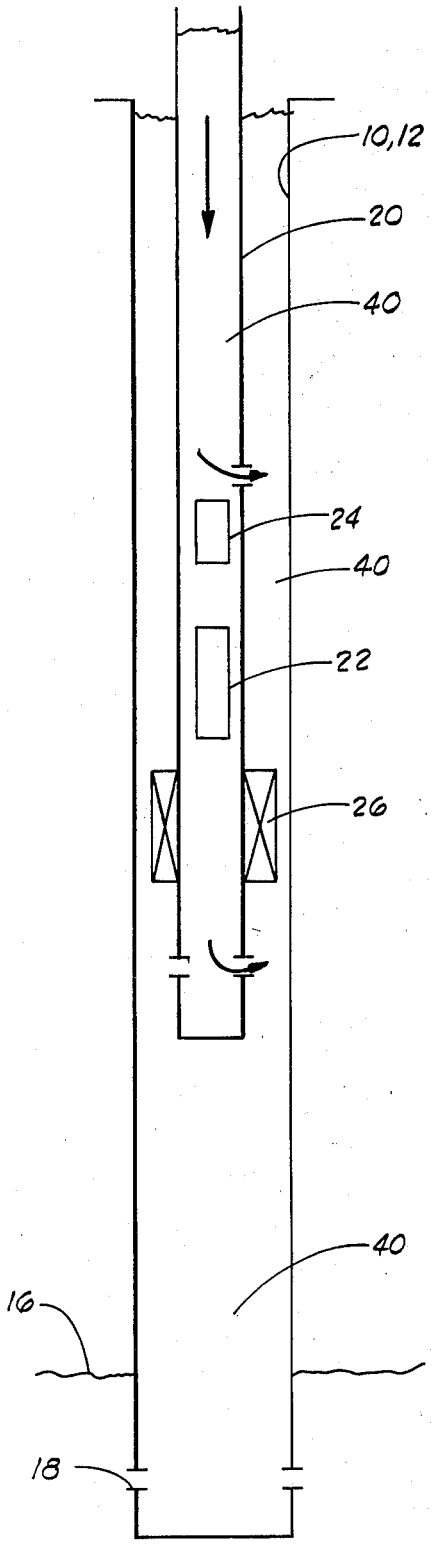

In FIG. 5, a reversing valve 52 has been opened allowing drilling mud 40 to enter the interior of pipe string 20 thus forcing the low gravity displacing fluid 30 back up out of the pipe string 20.

In FIG. 6 the pipe string 20 is in the process of being pulled out of the well bore 12. The packer 26 has been released and the drilling mud 40 is flowing out of the pipe string 20 back into the well bore 12 as the pipe string 20 is pulled out of the well bore 12. The sampler assembly 22 is being retrieved with the pipe string 20.

Referring now to FIGS. 7A–7K, a section elevation right side only view is thereshown of a fluid sampling apparatus 100. The fluid sampling apparatus 100, with reference to FIG. 1, is equivalent to the sampler assembly 22 and the portion of pipe string 20 surrounding sampler assembly 22. A longitudinal axis of apparatus 100 is designated as 101.

Fluid sampling apparatus 100 includes an upper adapter 102 having an internally threaded surface 104 for attachment to a lower end of a pipe string 20. Attached to upper adapter 102 is an actuating mandrel 106 which includes an upper actuating mandrel section 108 (see FIG. 7A), a lower actuating mandrel section 110 (see FIG. 7C), and a middle actuating mandrel section 112 connecting upper and lower sections 108 and 110.

Fluid sampling apparatus 100 includes a housing 114. As seen in FIGS. 7B and FIG. 8 the actuating mandrel 106 includes a pair of diametrically opposed radially outward extending splines 116 (only one of which is shown) which are received in a pair of diametrically opposed longitudinally extending grooves 118 (only one of which is shown) in housing 114. Thus relative rotational movement between actuating mandrel 106 and housing 114 is prevented.

Below splines 116 there is disposed about actuating mandrel 106 a rotating collar 120 held in place by a keeper ring 122. As is best seen in FIG. 9 the collar 120 includes a pair of diametrically opposed lugs 124 (only one of which is shown) which are received within a pair of diametrically opposed J-slots 126 (only one of which is shown). A layed out view of J-slot 126 and the various positions of lug 124 is shown in FIG. 12.

The housing 114 includes a first section 128, a second section 130, a third section 132, a fourth section 134, a fifth section 136, a sixth section 138 and a seventh section 140. All the sections of the housing 114 are threadedly connected together as illustrated.

A port 142 is disposed through section 128 of housing 114 and communicates an annulus between the housing 114 and the well bore 12 with a space 144 within the housing 114.

A sliding seal 146 seals between second section 130 of housing 114 and an outer cylindrical surface 148 of actuating mandrel 106.

A port 150 is disposed through actuating mandrel 106 below seal 146.

A sliding seal 152 is disposed in an outer surface of middle section 112 of actuating mandrel 106 for sealing against an inner cylindrical surface of second section 130 of housing 114. A typical sliding seal comprises three fluorocarbon O-rings backed up on each side with rectangular cross section filled teflon rings.

A static seal 154 is provided between middle section 112 and lower section 110 of actuating mandrel 106. A typical static seal includes one fluorocarbon O-ring backed up with teflon rings.

An annular sealed chamber 156 is defined between section 110 of actuating mandrel 106 and section 130 of housing 114 as seen in FIGS. 7C and 7D.

A second annular chamber 158 is defined between lower section 110 of actuating adapter 106 and section 134 of housing 114 as seen in FIGS. 7D and 7E.

A longitudinal outlet passageway 160 communicates chambers 156 and 158. There is disposed in passageway 160 a restricted orifice 162. At the upper and lower ends of passageway 160 are provided filter means 164 and 166 for preventing particulate materials from entering and clogging the orifice 162.

The chambers 156 and 158 are filled with hydraulic fluid under a vacuum at ports 168 and 170 which are then plugged with plugs 172 and 174 respectively.

The chambers are sealed from well fluids at several points by static seals 176 and sliding seals 178 to confine the hydraulic fluid therein.

As will be further described below, when actuating mandrel 106 is moved downward relative to housing 114, a volume of chamber 156 is decreased and hydraulic fluid from first chamber 156 is forced through the restricted orifice 162 into the second chamber 158 thus retarding downward movement of actuating mandrel 106 and providing a predetermined period of time required to accomplish a given distance of travel. Thus proper sizing of the restricted orifice 162 can provide any desired time period (e.g. up to several minutes) for the appropriate length of travel of the actuating mandrel 106.

This time delay is primarily to control the opening of the valve of the sampler assembly, but also prevents mandrel 106 from moving downward relative to housing 114 when lowering pipe string 20 into well 10, or when too much time is spent setting packer 26.

An annular floating piston 180 is located in chamber 158 and seals against both the actuating mandrel 106 and the housing 114 by means of seals 182 to keep well fluid out of the chamber 158 above the floating piston 180. The portion of chamber 158 below floating piston 180 is communicated with the annulus between housing 114 and the well bore 12 by a port 184 shown in FIG. 7E.

A sliding seal between actuating mandrel 106 and section 136 of housing 114 is provided at seal 186.

There is no change of internal volume within housing 114 when mandrel 106 moves downward relative thereto because the area of mandrel 106 at seal 186 is the same as a differential area between seals 146 and 152.

A lower end 188 of actuating mandrel 106 is adapted for engagement with an upper end 190 of a sampler assembly generally indicated by the numeral 192. A plurality of slots 194 communicate the interior of actuating mandrel 106 with the interior of housing 114 below actuating mandrel 106.

Referring to FIGS. 7F through 7K, the sampler assembly 192 includes a first tubular section 196 having an open upper end 198 and a closed lower end 200.

First tubular section 196 includes a first portion 202, a second portion 204, a third portion 206, and a fourth portion 208, all of which are threadedly connected together as illustrated.

A second tubular section 210 of sampler assembly 192 includes an open lower end 212 and a closed upper end 214.

Second tubular section 210 includes first and second portions 216 and 218.

The second portion 218 has an internally threaded upper end 220 within which is loosely received a smooth tapered lower surface 217 of first portion 216. Threads 220 are for use in removal of second portion 218 upon disassembly of the apparatus.

The open lower end 212 of second tubular section 210 is telescopingly received within the open upper end 198 of first tubular section 196 of sampler assembly 192.

The interiors of first and second tubular sections 196 and 210 of sampler assembly 192 define a sample chamber 222.

The upper end of sample chamber 222 is defined by an upper plug 224. Plug 224 includes a lower tapered surface 226 which sealingly engages an upward facing tapered surface 228 of second tubular section 210.

Plug 224 is held in place by member 230 which includes external threads 232 which are engaged with internal threads 234 of second tubular section 210. Member 230 includes a socket 236 in the upper end thereof for receiving a tool (not shown) for rotating member 230 so as to move member 230 upward or downward relative to second tubular section 210.

Similarly, a plug 224 (see FIG. 7K) defines the lower end of sample chamber 222.

First tubular section 196 of sampler assembly 192 is held in place within housing 114 between a downward facing shoulder 238 of fifth section 136 of housing 114 and an upward facing shoulder 240 of seventh section 140 of housing 114.

Sliding seals 242 and 244 are provided between first portion 216 of second tubular section 210 and first portion 202 of first tubular section 196. Sliding seal 246 is provided between first portion 216 of second tubular section 210 and second portion 204 of first tubular section 196.

A port 248 communicates sample chamber 222 with a differential area on first portion 216 of second tubular section 210, which differential area is the difference between an inner diameter 250 against which seal 244 seals, and an outer diameter 252 against which seal 242 seals.

The second portion 218 of second tubular section 210 of sampler assembly 192 may also be referred to as a shuttle valve 218 or a sleeve valve means 218. The shuttle valve 218 includes a port 254 which communicates with sample chamber 222.

Disposed in an outer cylindrical surface of shuttle valve 218 above port 254 are first and second longitudinally spaced sliding seals 256 and 258. Located below port 254 are sliding seals 260 and 262.

Disposed through third portion 206 of first tubular section 196 of sampler assembly 192 is a port 264 which communicates with an annular space 266 between first tubular section 196 and housing 114.

In FIG. 7I the shuttle valve 218 is shown in a closed first position with the port 264 located between seals 260 and 262 so that port 264 is isolated from sample chamber 222.

Upon downward movement of shuttle valve 218 relative to first tubular section 196 of sampler assembly 192 the seal 260 moves below port 264 so that port 264 comes into fluid communication with port 254 of the shuttle valve 218 thus placing sample chamber 222 in fluid communication with the annular space 266 for a period of time until the seal 256 moves below port 264. During the period of time in which the ports 254 and 264 are in fluid communication with each other, fluid produced from the subterranean formation 16, which fluid is located in the annular space 266, flows through ports 264 and 254 into sample chamber 222, thus filling the same with fluid from the subterranean formation. When the seal 256 moves below port 264 the sample is sealed within sample chamber 222.

A closed third position of shuttle valve 218 is defined such that the seals 256 and 258 are on opposite sides of port 264 thus again isolating the port 264 from the sample chamber 222.

The manner of operation of the fluid sampling apparatus 100 of FIGS. 7A through 7K is generally as follows.

Figure 7K:
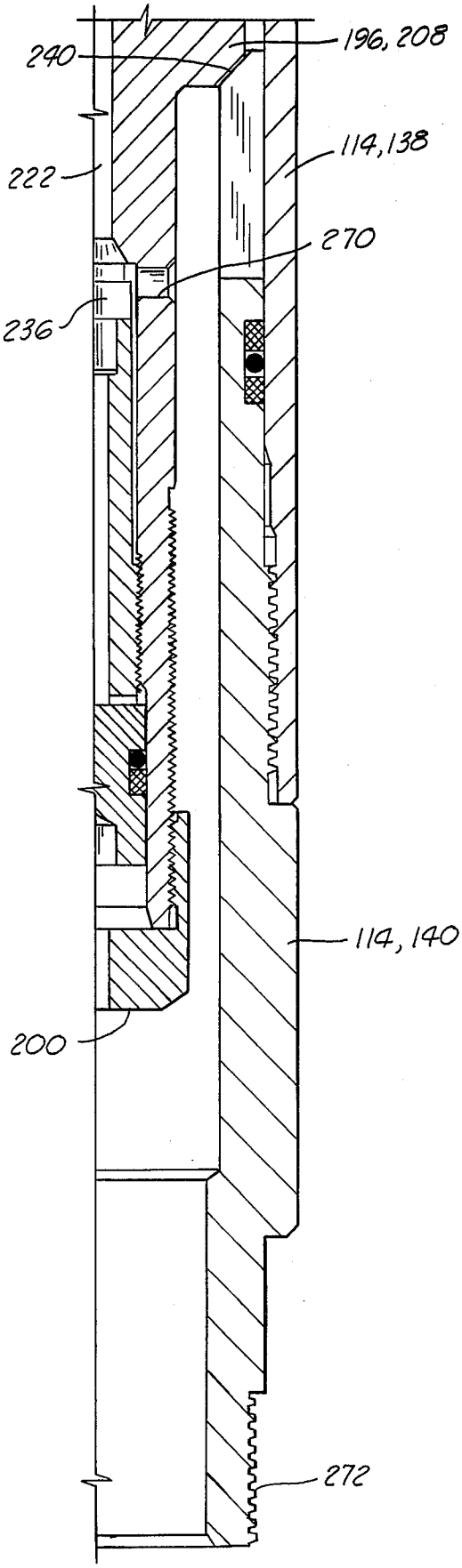

The sampler assembly 192 is assembled, and the sample chamber 222 thereof is evacuated through ports 268 (see FIG. 7F) and 270 (see FIG. 7K). The evacuated sample chamber 222 is sealed by plugs 224 and 236.

The fifth and sixth sections 136 and 138 of housing 114 are not yet assembled, and the sampler assembly 192 is placed within housing 114 and then the fifth and sixth sections 136 and 138 are made up so that the shoulder 238 retains sampler assembly 192 in the housing 114.

Then the remainder of the structure is made up together as shown in FIGS. 7A–7K, and the upper adapter 102 is threadedly attached to pipe string 20. The packer means 26 is attached to threads 272 of seventh section 140 of housing 114.

Then the pipe string 20 is lowered into the well as previously described with regard to FIGS. 1 and 2.

The operation of filling the sample chamber 222 of sampler assembly 192 (as was previously described with regard to sample chamber 222 of FIG. 3) is then carried out as follows.

Referring to FIG. 12 the lug 124 and J-slot 126 are thereshown in a layed out position.

The packer means 26 is of such a design that it is set within the well bore 12 by setting down weight on the pipe string 20. When weight is first set down on the pipe string 20 the lug 124 moves from a first position illustrated in FIG. 12 as 124A to a second position illustrated in FIG. 12 as 124B, thus setting the packer means 26. When the lug is in the second position 124B, the lower end 188 (see FIG. 7F) of actuating mandrel 106 still does not quite engage the upper end 190 of sampler assembly 192.

When it is desired to open the shuttle valve 218 by moving it to a position where port 254 is communicated with port 264, the pipe string 20 is first raised so that the lug 124 moves from second position 124B to third position 124C shown in dashed lines in FIG. 12.

This upward movement of the lug 124 and the attached actuating mandrel 106 relative to housing 114 is permitted by a check valve (not shown) disposed in third section 132 of housing 114. The check valve (not shown) communicates chambers 156 and 158 and allows fluid flow from chamber 158 upward to chamber 156 but does not allow fluid flow from chamber 156 to chamber 158. Thus, when the lug 124 is moved from second position 124B to third position 124C some of the fluid from chamber 158 flows back into chamber 156 through the check valve (not shown).

Then, weight is set down on pipe string 20 again thus applying a downward force to actuating mandrel 106 and moving it downward from the third position 124C to the fourth position 124D shown in FIG. 12.

The movement of the lug from position 124C to position 124D occurs over a period of time determined by the hydraulic time delay apparatus disposed in the housing 114 which includes the orifice 162 which restricts flow of hydraulic fluid from chamber 156 to chamber 158.

As the lug 124 moves from position 124C to position 124D the shuttle valve 218 (see FIG. 7I) moves from its closed first position illustrated in FIG. 7I through an open second position wherein port 254 and port 264 are communicated to a closed third position wherein seal 256 is located below port 264.

Thus it is seen that the shuttle valve 218 remains in an open position for a predetermined period of time which is dependent upon the size of the orifice 162. This period of time is sufficiently long that the sample chamber 222 may fill with fluid produced from the subterranean formation 16 into the annular space 266.

During relative telescoping movement between said first and second tubular sections 196 and 210 of sampler assembly 192 the volume of sample chamber 222 remains constant. This is provided by appropriate sizing of the diameters of seals 246, 244, and 242.

A cross sectional area of second tubular section 210 at seal 246, i.e. a circular area having a diameter equal to the outside diameter of tubular section 210 at seal 246, is equal to the differential area between seals 242 and 244, which differential area is in fluid communication with sample chamber 222 through port 248, so that fluid displaced by said cross sectional area of second tubular section 210 at seal 246 from the interior of first tubular section 196 upon telescopic collapse of sampler assembly 192 is received by said differential area between seals 242 and 244.

Sampler assembly 192 is therefore unaffected by either external or internal pressure.

The remainder of the process is such as is previously described with regard to FIGS. 1–6.

After the pipe string 20 is pulled from the well bore 12 the sampler assembly 192 is removed therefrom in the following manner.

Initially, the housing 114 will be broken at the threaded connection 274 between sections 134 and 136 of housing 114. The actuating mandrel 106 can be withdrawn upwardly from the section 136 of housing 114. The packer means 26 can be removed from the lower end of housing 114, so that the sections 136, 138 and 140 of housing 114 containing the sampler assembly 192 are thus separated from the remainder of the tool string. This portion of housing 114 which contains the sampler assembly 192 may then be carried to a convenient place by laying the same in the bed of a truck or the like. This portion of the housing 114 thus serves as a mechanical protector or an armor-like protector for the sampler assembly 192 to protect the same from damage during transport and also to protect personnel from the possibility of explosion of the sampler assembly 192.

It must be kept in mind that the fluid sampling apparatus 100 is expected to operate in 20,000 psi and 450° F. environments. All metals and seal materials are compatible with that environment. Nevertheless, because of the fact that the sampler assembly 192 may contain a fluid at pressures of 20,000 psi, there is a danger of explosion if the sampler assembly 192 were damaged, and thus the protective armor provided by housing 114 is very important during the process of transporting the sampler assembly 192 to a lab or the like where it will be emptied for testing of the fluid contained therein.

Once the assembly is transported to a lab where the testing is to be conducted, the sections 136 and 138 of housing 114 are disassembled at threaded connection 276 and the sampler assembly 192 may be removed from the housing 114.

Referring now to FIG. 13, the cap 276 (see FIG. 7F) has been removed from the upper end of sampler assembly 192 and a collar 278 is placed over an outer cylindrical surface 280 of first portion 216 of second tubular section 210 of sampler assembly 192. Collar 278 is held in place by a locking nut 282.

A plurality of seals 284 are provided between cylindrical surface 280 and collar 278. The collar 278 includes a passageway 286 communicated with port 268. A device (not shown) for receiving the sample from sample chamber 222 is connected to an outer end 288 of passageway 286. Then a tool (not shown) is engaged with socket 236 of member 230 and rotated so as to move the member 230 upward thus releasing plug 224 from its sealing engagement with surface 228 and allowing the fluid sample from sample chamber 222 to flow through port 268 and passageway 286.

EMBODIMENT OF FIGS. 14A–14F

FIGS. 14A–14F illustrate a fluid sampling apparatus 300.

The fluid sampling apparatus 300 differs from the fluid sampling apparatus 100 only in the upper portions above section 138 of housing 114 and above the sampler assembly 192. Only this upper portion of fluid sampling apparatus 300 is shown, and it will be understood that the apparatus shown in FIGS. 14A–14F can be substituted for the apparatus shown in FIGS. 7A–7F, with the lower portions which are shown in FIGS. 7G–7K being identical for both structures.

Fluid sampling apparatus 300 includes an actuating mandrel 302 which has a piston 304 defined thereon.

A sliding seal 306 seals between piston 304 and an inner cylindrical surface 308 of an upper housing portion 310.

A sliding seal 312 is provided between an outer cylindrical surface 314 of actuating mandrel 302 and an upper adapter 316.

A port 318 communicates an annulus between the apparatus 300 and the well bore 12 (see FIG. 1) with a chamber 320 located above an upper end 322 of piston 304.

Actuating mandrel 302 is initially frangibly retained in place within the housing by shear pins 324 and a shear pin collar 326.

Sliding seals 327 and 329 are provided between actuating mandrel 302 and a housing section 331, thus defining a sealed annular chamber 333. Chamber 333 is filled with gas (e.g. air) at atmospheric pressure prior to lowering of apparatus 300 into the well 10.

Thus a differential area associated with actuating mandrel 302 is defined between seals 312 (see FIG. 14A) and 327 (see FIG. 14E), with a differential pressure applied thereacross being the difference between annulus pressure in well 10 and the atmospheric pressure in sealed chamber 333.

To move actuating mandrel 302 downward, annulus pressure is increased until pins 324 shear thus allowing mandrel 302 to move downward.

The area of mandrel 302 at seals 312 and 329 is equal so that pressure within a mandrel 302 imparts no longitudinal forces on mandrel 302.

Downward movement of mandrel 302 is slowed by a hydraulic time-delay mechanism 328. This mechanism 328 could be constructed identical to the one shown in FIG. 7D utilizing an orifice like orifice 162, but in FIG. 14C an alternative version of time-delay mechanism is shown which includes a long cylindrical pin 330 which is very closely received in a long bore 332. Thus hydraulic fluid from a chamber 334 flows through the very small annular area between pin 330 and bore 332 into a chamber 336. Thus the time for downward movement of actuating mandrel 302 is determined by the clearance between pin 330 and bore 332.

An annular floating piston 338 is disposed in chamber 336. The lower end of chamber 336 is open at port 340 for communication with the annulus between apparatus 300 and the well bore 12.

The operation of the structure 300 is similar to that of the structure 100, except that downward forces are applied to the actuating mandrel 302 by pressuring the annulus between the pipe string 20 and the well bore 12 rather than by setting down weight on the pipe string 20.

THE EMBODIMENT OF FIGS. 15A–15E

Another embodiment of the present invention is shown in FIGS. 15A through 15E. A fluid sampling apparatus is designated generally by the numeral 400. Again, the portion of the apparatus 400 below section 138 of housing 114 and the portion including the sampler assembly 192 are identical to that shown in FIGS. 7G through 7K. The fluid sampling apparatus 400 includes an actuating mandrel 402 having a piston 404 defined thereon. A seal 406 is provided between the piston 404 and an inner cylindrical housing surface 408.

A seal 410 is provided between a cylindrical surface 412 of mandrel 402 and a housing adapter 414.

Housing adapter 414 and actuating mandrel 402 are initially frangibly connected by a shear pin 416.

A chamber 418 defined between seals 406 and 410 is communicated with an annulus between the apparatus 400 and the well bore 12 by a port 420.

Figure 15A:
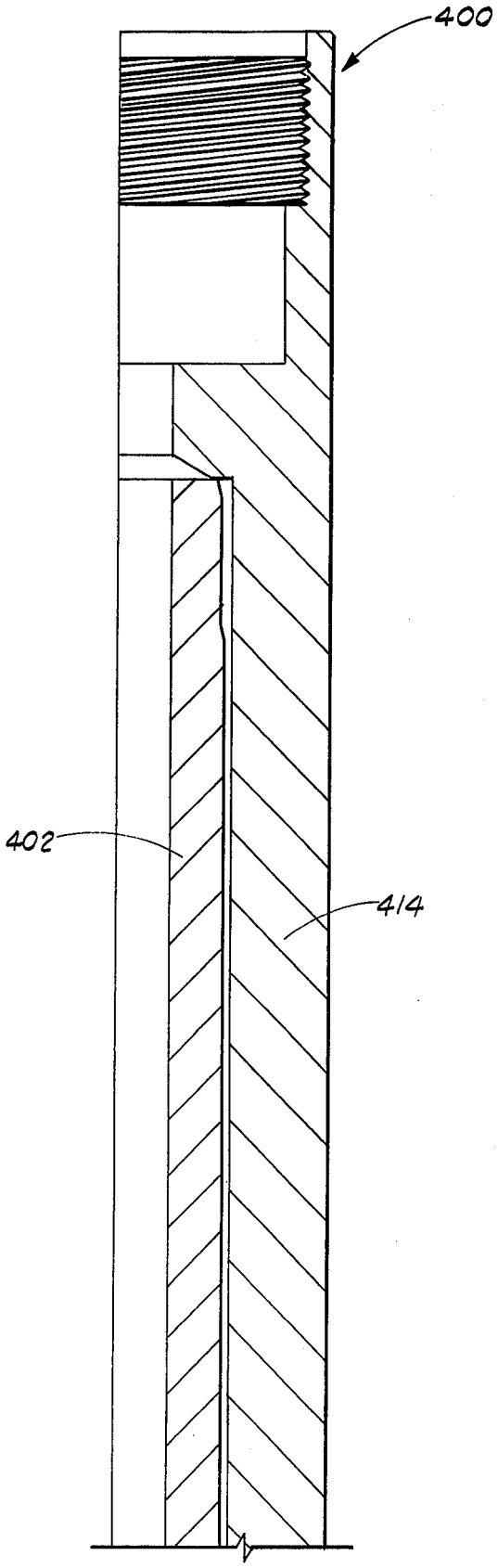
Figure 15B:
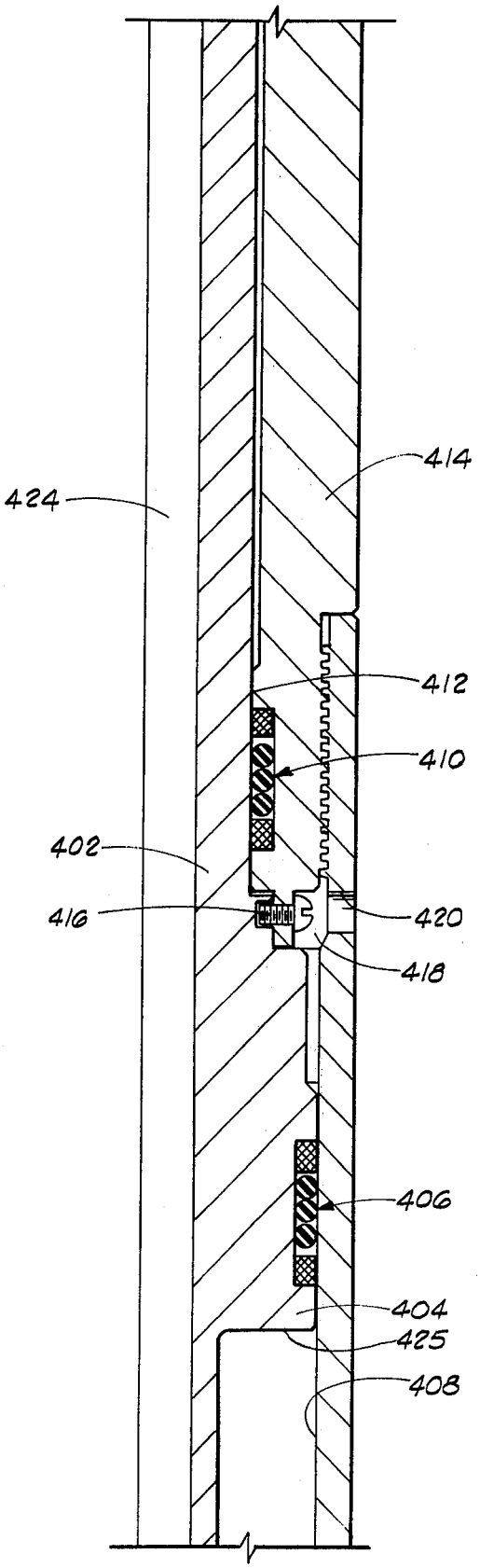
Figure 15C:
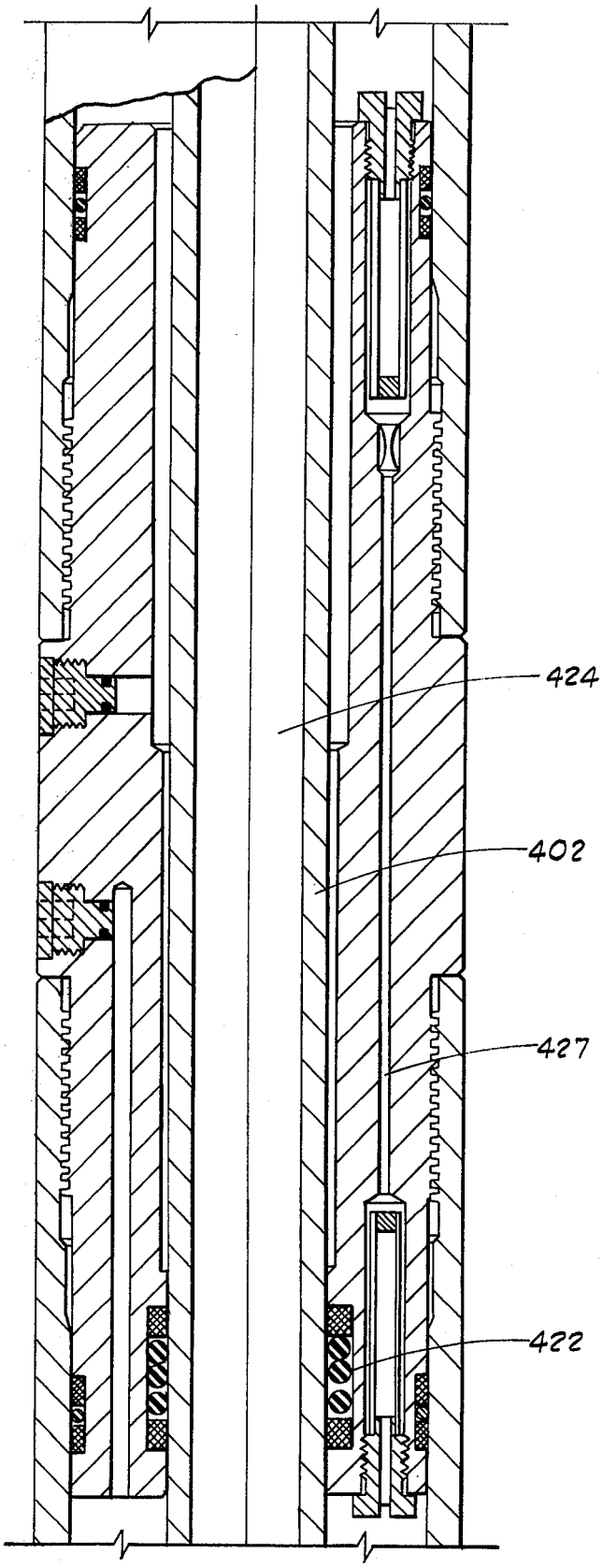
Figure 15D:
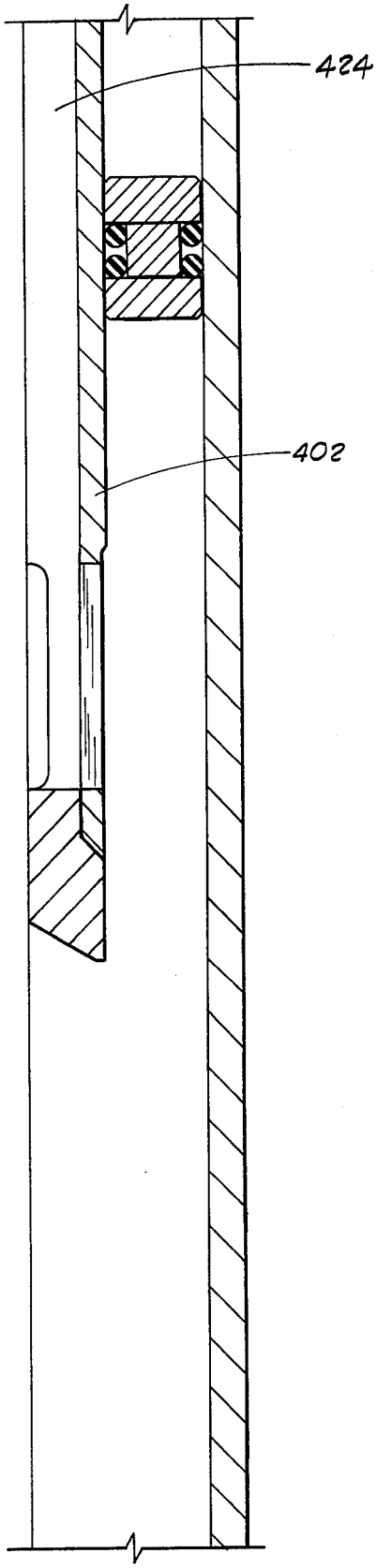
Figure 15E:
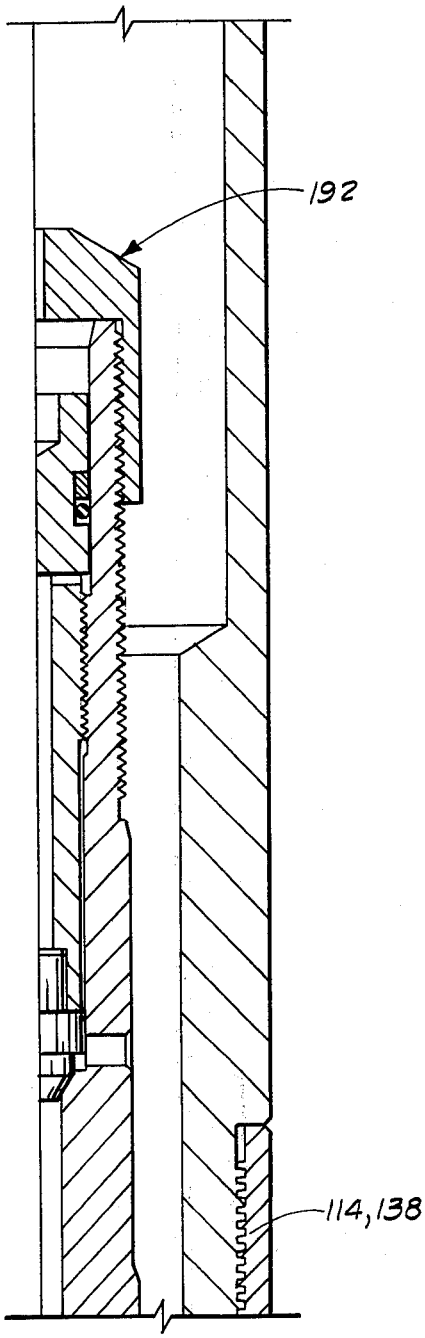

A lower portion of actuating mandrel 402 seen in FIG. 15C is received in the housing and a seal is provided by seal 422. The portions of actuating mandrel 402 below seal 422 are in fluid communication with interior 424 of actuating mandrel 402 which is in fluid communication with the interior of pipe string 20.

A lower surface 425 of piston 404 is in fluid communication with interior 424 through longitudinal passageway 427.

Thus, when there is a pressure differential between the interior of pipe string 20, and the annulus between the pipe string 20 and well bore 12, that pressure differential acts downward on a differential area defined between seals 410 and 406 thus shearing the shear pin 416 and moving actuating mandrel 402 downward into engagement with the sampler apparatus 192.

This pressure differential is created by opening valves 34 and 44 (see FIG. 1) and allowing displacing fluid 30 to flow up out of pipe string 20 thus allowing fluid 46 from formation 16 to flow into pipe string 20. After the predetermined time delay from the restriction in passageway 427 (FIG. 15C) the mandrel 402 moves valve 218 through its close-open-close cycle.

Thus it is seen that the apparatus and methods of the present invention readily achieve the ends and advantages mentioned as well as those inherent therein. While numerous preferred embodiments of the invention have been illustrated for the purpose of this disclosure, many changes in the arrangement and construction of the parts and steps can be made by those skilled in the art, which changes are within the scope and spirit of this invention as defined by the appended claims.

What is claimed is:

1. A method of sampling a fluid produced from a subterranean formation, said method comprising the steps of:

evacuating a sample chamber of a sampler assembly;

lowering said evacuated sampler assembly into a well intersecting said subterranean formation;

flowing said fluid from said subterranean formation around said sampler assembly and upward past said sampler assembly while said sample chamber remains evacuated;

opening a sliding sleeve valve means associated with said evacuated sample chamber by sliding said sliding sleeve valve means from a closed first position to an open second position and thereby communicating said sample chamber with said produced fluid for a period of time sufficent to allow said sample chamber to fill with a sample of said produced fluid; and closing said sliding sleeve valve means by sliding said sliding sleeve valve means from an open second position to a closed third position to seal said sample of said produced fluid in said sample chamber whereby said steps of opening and closing said sliding sleeve valve means are accomplished by one continuous sliding movement of said sliding sleeve valve means from a closed first position through an open second position to a closed third position.

2. The method of claim 1, said sampler assembly including first and second telescoping tubular members the interiors of which are communicated to define said sample chamber, said sliding sleeve valve being associated with said telescoping tubular members, wherein:

said one continuous sliding movement of said sleeve valve is accomplished by:

engaging one of said telescoping tubular members from above with a lower end of an actuating mandrel; and applying a downward force to said actuating mandrel and thus to said one of said telescoping tubular members to move said actuating mandrel and said one tubular member downward relative to the other of said tubular members.

3. The method of claim 2, further comprising:

slowing said downward movement of said actuating mandrel by confining a volume of hydraulic fluid so that upon downward movement of said actuating mandrel said confined hydraulic fluid is forced through a restricted opening, thereby providing said period of time in which said valve means is open to allow said sample chamber to fill.

4. The method of claim 2, wherein:

said step of applying a downward force on said actuating mandrel includes a step of setting down weight on a pipe string to which said actuating mandrel is attached.

5. The method of claim 2, wherein:

said step of applying a downward force on said actuating mandrel includes a step of increasing pressure in an annulus between a well bore and a housing in which said sampler assembly is received, said annulus being communicated with an upper side of a differential area means associated with said actuating mandrel, and thus creating a pressure differential across said differential area means.

6. The method of claim 5, further comprising a step of:

initially frangibly restraining said actuating mandrel against said downward movement thereof.

7. The method of claim 2, wherein:

said step of applying a downward force on said actuating mandrel includes a step of decreasing a pressure in an interior of a pipe string, said sampler assembly and said actuating mandrel being received in a housing attached to said pipe string, said interior of said pipe string being communicated with a lower side of a differential area means associated with said actuating mandrel, and thus creating a pressure differential across said differential area means.

8. The method of claim 2, wherein:

said step of opening said valve means is accomplished while said fluid is flowing from said subterranean formation upward past said sampler assembly.

9. The method of claim 2, wherein:

said step of opening said valve means is accomplished while said well is shut in.

10. The method of claim 2, further comprising a step of:

maintaining a volume of said sample chamber constant during relative telescoping movement between said telescoping tubular members.

11. The method of claim 1, wherein:

prior to said lowering step, said method includes steps of placing said sample chamber in a housing, attaching said housing to a lower end of a pipe string, and attaching a packer means to a lower end of said housing; and said lowering step is further characterized as lowering said pipe string into said well.

12. The method of claim 11, further comprising:

allowing an interior of said pipe string to fill with drilling mud as said pipe string is lowered into said well;

pumping a displacing fluid down inside said pipe string to displace said drilling mud;

setting said packer means to seal an annulus between said pipe string and a bore of said well above said subterranean formation; and wherein said flowing step is further characterized as flowing said displacing fluid upward out of said pipe string thus allowing said fluid produced from said subterranean formation to flow upward through said housing, around said sampler assembly, and into said pipe string.

13. The method of claim 12, further comprising:

after said step of closing said valve means, forcing said produced fluid, other than the sample thereof in the sample chamber, downward out of said pipe string and back into said subterranean formation, by pumping said displacing fluid into said pipe string above said produced fluid;

opening a reversing valve in said pipe string thereby allowing drilling mud to fill said pipe string and move said displacing fluid upward out of said pipe string; and pulling said pipe string, with said housing and sampler assembly attached thereto, out of said well.

14. A fluid sampling apparatus, comprising:

a housing;

a sampler assembly received in said housing, said sampler assembly including:

a first tubular section having an open first end and a closed second end;

a second tubular section having an open first end and a closed second end, said open end of said second tubular section being telescopingly received in said open end of said first tubular section so that an interior of said first tubular section is communicated with an interior of a second tubular section to define a sample chamber including said interiors of said first and second tubular sections; and sleeve valve means, associated with said first and second tubular sections, said sleeve valve means being movable from a closed first position through an open second position to a closed third position upon one continuous telescopingly collapsing movement between said first and second tubular sections, said sample chamber being in fluid communication with an annular space between said housing and said tubular sections when said valve means is open;

an actuating mandrel means, slidably received in said housing above said sampler assembly, for engaging an upper end of one of said tubular sections of said sampler assembly and for telescopingly collapsing said first and second tubular sections; and time delay means, operatively associated with said actuating mandrel means, for retarding downward movement of said actuating mandrel means so that said valve means is open for a predetermined period of time before it moves to said closed third position.

15. The apparatus of claim 14, wherein said time delay means includes:

a sealed chamber within which a hydraulic fluid may be confined;

piston means attached to said actuating mandrel and defining a surface of said sealed chamber so that a volume of said sealed chamber is decreased upon downward movement of said actuating mandrel;

an outlet passage communicated with said sealed chamber for allowing said hydraulic fluid to flow out of said sealed chamber; and restriction means, located in said outlet passage, for restricting flow of said hydraulic fluid through said outlet passage.

16. The apparatus of claim 15, wherein:

said restriction means is a restricted orifice.

17. The apparatus of claim 15, wherein:

said restriction means is a cylindrical pin closely received in a cylindrical portion of said outlet passage.

18. The apparatus of claim 14, wherein:

said first and second tubular sections of said sampler assembly are so arranged and constructed that said sample chamber has a constant volume for all relative telescopic positions of said first and second tubular sections.

19. The apparatus of claim 18, wherein:

said first and second tubular sections each further include a closed second end.

20. The apparatus of claim 14, wherein:

a cross-sectional area of said second tubular member at a first sliding seal between said first and second tubular members is equal to a differential area between second and third sliding seals between said first and second tubular members, said differential area being in fluid communication with said sample chamber, so that fluid displaced by said cross-sectional area of said second tubular member at said first sliding seal from said interior of said first tubular member upon telescopic collapse is received by said differential area, thus providing said constant volume of said sample chamber.

21. The apparatus of claim 11, wherein:

said actuating mandrel has a radially outward extending lug associated therewith, said lug being received in a J-slot disposed in said housing; and said J-slot and said lug are so arranged and constructed that when weight is first set down on said actuating mandrel said lug moves from a first position in said J-slot downward to a second position in said J-slot such that a lower end of said actuating mandrel is still above an upper end of said sampler assembly, and when said actuating mandrel is subsequently picked up and weight then set down thereon a second time said lug moves from said second position upward to a third position then downward to a fourth position such that travel of said lug from said third position to said fourth position corresponds to telescoping collapse of said sampler assembly and movement of said valve means from its said closed first position through its said open second position to its said closed third position.

22. The apparatus of claim 21, wherein:

said actuating mandrel is rotationally fixed relative to said housing; and said lug is disposed on a collar rotatingly received on said actuating mandrel.

23. The apparatus of claim 14, wherein:

said actuating mandrel has a differential area associated therewith, said differential area being in fluid communication with an exterior of said housing, for moving said actuating mandrel downward relative to said housing in response to a pressure increase at said exterior of said housing.

24. The apparatus of claim 23, wherein:

said differential area is also in fluid communication with a sealed chamber containing a gas under substantially atmospheric pressure.

25. The apparatus of claim 24, further comprising:

frangible restraining means for initially restraining downward movement of said actuating mandrel.

26. The apparatus of claim 14, wherein:

said actuating mandrel has a differential area means associated therewith, said differential area means being in fluid communication with an exterior of said housing and with an interior of said actuating mandrel, for moving said actuating mandrel downward relative to said housing in response to a pressure differential between said exterior of said housing and said interior of said actuating mandrel.

27. The apparatus of claim 26, further comprising:

frangible restraining means for initially restraining downward movement of said actuating mandrel.

28. The apparatus of claim 14, further comprising:

a pipe string having a lower end attached to an upper end of said housing; and packer means, attached to a lower end of said housing, for sealing an annulus between said pipe string and a well bore.

* * * * *

UNITED STATES PATENT AND TRADEMARK OFFICE

CERTIFICATE OF CORRECTION

PATENT NO. : 4,417,622

DATED : November 29, 1983

INVENTOR(S) : Walter E. Hyde

It is certified that error appears in the above-identified patent and that said Letters Patent is hereby corrected as shown below:

In column 1, line 22, delete "provids" and insert -- provides --.

In column 13, line 41 through 43, delete claim number 19 in its entirety as follows:

[19. The apparatus of claim 18, wherein:
said first and second tubular sections each further include a closed second end.]

In column 13, line 44, delete the number [20] and insert therefor --19--.

In column 13, line 57, delete the number [21] and insert therefor --20--.

In column 13, line 57, delete the number [11] and insert therefor --14--.

In column 14, line 21, delete the number [22] and insert therefor --21--.

In column 14, line 21, delete the number [21] and insert therefor --20--.

In column 14, line 26, delete the number [23] and insert therefor --22--.

In column 14, line 33, delete the number [24] and insert therefor --23--.

In column 14, line 33, delete the number [23] and insert therefor --22--.

In column 14, line 37, delete the number [25] and insert therefor --24--.

UNITED STATES PATENT AND TRADEMARK OFFICE

CERTIFICATE OF CORRECTION

PATENT NO. : 4,417,622

DATED : November 29, 1983

INVENTOR(S) : Walter E. Hyde

It is certified that error appears in the above-identified patent and that said Letters Patent is hereby corrected as shown below:

In column 14, line 37, delete the number [24] and insert therefor --23--.
In column 14, line 40, delete the number [26] and insert therefor --25--.
In column 14, line 49, delete the number [27] and insert therefor --26--.
In column 14, line 49, delete the number [26] and insert therefor --25--.
In column 14, line 52, delete the number [28] and insert therefor --27--.

Signed and Sealed this

*Thirty-first* Day of *July 1984*

[SEAL]

*Attest:*

GERALD J. MOSSINGHOFF

*Attesting Officer*

*Commissioner of Patents and Trademarks*